US008170454B2

(12) United States Patent
Yamada et al.

(10) Patent No.: US 8,170,454 B2
(45) Date of Patent: May 1, 2012

(54) IMAGE FORMING APPARATUS AND IMAGE FORMING METHOD

(75) Inventors: Yoichi Yamada, Shiojiri (JP); Daisuke Matsumoto, Matsumoto (JP); Takatomo Fukumoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 492 days.

(21) Appl. No.: 12/511,848

(22) Filed: Jul. 29, 2009

(65) Prior Publication Data

US 2010/0061775 A1 Mar. 11, 2010

(30) Foreign Application Priority Data

Sep. 11, 2008 (JP) ..... 2008-232895

(51) Int. Cl.
*G03G 15/08* (2006.01)

(52) U.S. Cl. ..... 399/285

(58) Field of Classification Search ..... 399/285
See application file for complete search history.

(56) References Cited

U.S. PATENT DOCUMENTS

| | | | | |
|---|---|---|---|---|
| 4,913,088 | A * | 4/1990 | Kanbe et al. | 399/270 |
| 6,788,913 | B1 | 9/2004 | Aoki et al. | 399/279 |
| 7,072,597 | B2 | 7/2006 | Shimura et al. | |
| 7,260,336 | B2 | 8/2007 | Shimura et al. | |
| 2007/0110481 | A1 | 5/2007 | Yamada et al. | |

FOREIGN PATENT DOCUMENTS

| | | | |
|---|---|---|---|
| JP | 06-110309 | | 4/1994 |
| JP | 11-065270 | | 3/1999 |
| JP | 11119522 | A | 4/1999 |
| JP | 11174845 | A | 7/1999 |
| JP | 2000-275961 | | 10/2000 |
| JP | 2001296684 | A | 10/2001 |
| JP | 2003208012 | A | 7/2003 |
| JP | 2005352248 | A | 12/2005 |
| JP | 2006313257 | A | 11/2006 |
| JP | 2007-127800 | | 5/2007 |
| JP | 2007-140080 | | 6/2007 |
| JP | 2007140545 | A | 6/2007 |

* cited by examiner

*Primary Examiner* — David Gray
*Assistant Examiner* — Andrew Do
(74) *Attorney, Agent, or Firm* — DLA Piper LLP (US)

(57) ABSTRACT

An image forming apparatus includes: a latent image holder that holds on its surface an electrostatic latent image in which an image portion and a non-image portion have different potentials; a toner carrying roller that carries a toner layer including both contact toner which directly contacts a surface of the roller and non-contact toner which contacts the contact toner but does not contact the surface of the roller; and an electric field forming unit that forms an alternating electric field to cause an electric field strength exerted between the non-image portion on the surface of the latent image holder and the surface of the toner carrying roller to be lower than a contact toner fly start electric field strength and higher than a non-contact toner fly start electric field strength, between the latent image holder and the toner carrying roller, as a toner fly electric field.

12 Claims, 14 Drawing Sheets

TONER PARTICLE SIZE Dt=4.5 μm

| SYMBOL | FLY START ELECTRIC FIELD STRENGTH |
|---|---|
| E0 | $8.6\times10^{6}$ V/m |
| E1 | $7.1\times10^{6}$ V/m |
| E2 | $3.9\times10^{6}$ V/m |

IMAGE FORMING APPARATUS AND IMAGE FORMING METHOD

BACKGROUND

1. Technical Field

The present invention relates to an image forming apparatus and an image forming method of developing an electrostatic latent image with toner while a latent image holder for holding an electrostatic latent image and a toner carrying roller for carrying toner are opposed to each other without being in contact.

2. Related Art

As a technique for developing an electrostatic latent image with toner, a technique of disposing a latent image holder for holding an electrostatic latent image and a toner carrying roller for carrying toner to be opposed to each other with a gap therebetween, and then developing an electrostatic latent image by causing the toner to fly into the gap, that is, a so-called non-contact developing method is known (for example, refer to JP-A-2007-127800). For this type of image forming apparatus, toner with a volume average particle size of 8 to 10 μm has been widely used. However, for the purpose of implementing high definition of images, speeding up processes, and decreasing fixing temperature, an additional reduction in particle size (for example, to cause the volume average particle size to be 5 μm or less) of toner is necessary.

However, it has been recently discovered that toner with such a smaller particle size exhibits different behavior from that of toner with a large diameter. For example, image force or van der Waals force exerted on charged toner with a small size by the toner carrying roller is increased, and it becomes difficult for the charged toner to fly from the toner carrying roller. Accordingly, it becomes difficult to develop an image with sufficient density. In addition, toner with a small particle size and a small mass has a property that it scatters easily and adheres to the inside or the outside of the image forming apparatus as a base fog. This results in the image being dirty.

Here, by increasing an amount of toner transported on the toner carrying roller or strengthening an electric field generated in the gap between the latent image holder and the toner carrying roller, it is possible to compensate for the insufficiency of the developing density. However, in this case, a larger amount of toner scatters, or a discharge occurs between the latent image holder and the toner carrying roller, resulting in an image being muddy. As described above, the object of obtaining a sufficient developing density and the object of suppressing toner scattering to the inside or the outside of an apparatus and suppressing base fog conflict with each other. In order to reconcile both these objects and achieve a reduction in toner particle size, the existing technique has to be improved.

SUMMARY

An advantage of some aspects of the invention is that it provides a technique of obtaining a sufficient developing density and simultaneously suppressing toner scattering to the inside and the outside of an apparatus and a base fog, for use with an image forming apparatus and an image forming method in a non-contact developing system in which a latent image holder and a toner carrying roller are opposed to each other with a gap therebetween.

According to an aspect of the invention, there is provided an image forming apparatus including: a latent image holder that holds on its surface an electrostatic latent image in which an image portion to which toner is to be adhered and a non-image portion to which toner is not to be adhered have different potentials; a toner carrying roller that has a roller shape to be opposed to the latent image holder with a predetermined gap therebetween, and carries a toner layer including both contact toner which directly contacts a surface of the roller and non-contact toner which contacts the contact toner but does not contact the surface of the roller; and an electric field forming unit that forms, when the electric field strength needed for a surface of the toner carrying roller to cause the non-contact toner to fly from the surface of the toner carrying roller is defined as the non-contact toner fly start electric field strength, and the electric field strength needed for the surface of the toner carrying roller to cause the contact toner to fly from the surface of the toner carrying roller is defined as the contact toner fly start electric field strength, an alternating electric field to cause the electric field strength exerted between the non-image portion on the surface of the latent image holder and the surface of the toner carrying roller to be lower than the contact toner fly start electric field strength and higher than the non-contact toner fly start electric field strength, between the latent image holder and the toner carrying roller, as a toner fly electric field.

With such a configuration, both the contact toner which directly contacts the surface of the toner carrying roller and the non-contact toner which does not directly contact the surface of the toner carrying roller are carried on the toner carrying roller. Accordingly, a sufficient amount of toner can be allowed to fly between the latent image holder and the toner carrying roller, thereby enhancing a developing density. On the other hand, when a toner fly electric field is increased to guarantee an amount of toner flying, toner scattering is likely to occur. Particularly, toner that flies from the surface of the toner carrying roller opposed to the non-image portion to which the toner does not need to be adhered causes a problem. This is because the toner may be adhered to the latent image holder while reciprocating due to an operation of the alternating electric field to cause a base fog or may escape from the binding force of the electric field and scatter, although the toner has to be finally returned to the surface of the toner carrying roller.

Here, the contact toner is strongly bound to the toner carrying roller by Coulomb force or van der Waals force exerted from the surface of the toner carrying roller. On the other hand, the non-contact toner is exerted with a relatively smaller binding force. From this point of view, the electric field strength needed to cause the toner to fly from the surface of the toner carrying roller is high at the contact toner and is relatively low at the non-contact toner. That is, the contact toner fly start electric field strength has a value higher than that of the non-contact toner fly start electric field strength. According to this aspect of the invention, the difference between the fly start electric field strengths is used in order to solve the above-mentioned problem.

More specifically, according to this aspect of the invention, the toner fly electric field formed between the non-image portion on the surface of the latent image holder and the surface of the toner carrying roller is set to be lower than the contact toner fly start electric field strength and higher than the non-contact toner fly start electric field strength. Under this condition, the non-contact toner is caused to fly between the non-image portion and the surface of the toner carrying roller but the contact toner is less likely to fly from the surface of the toner carrying roller. In many cases, the contact toner directly contacting the toner carrying roller has a higher charge than the non-contact toner. Therefore, the toner may be adhered to the non-image portion while flying and reciprocating in the alternating electric field to cause a base fog or scatter in the apparatus. According to this aspect of the invention, the contact toner does not fly between the non-image portion on the surface of the latent image holder and the surface of the toner carrying roller, so that the generation of the base fog or the toner scattering can be suppressed. Moreover, since the non-contact toner is caused to fly to contribute to the developing operation, a degradation of the developing density caused by a reduction in the amount of the toner flying can be suppressed.

As described above, according to the aspect of the invention, since both the contact toner and the non-contact toner are carried on the toner carrying roller, a sufficient amount of toner flying can be obtained even in the relatively low toner fly electric field, resulting in an increase in the developing density. In addition, since the toner fly electric field is suppressed to be low, the toner scattering can also be suppressed. In addition, since the contact toner is not allowed to fly between the non-image portion on the surface of the latent image holder and the surface of the toner carrying roller, the toner scattering can further be suppressed, and the adhesion of the toner to the non-image portion of the latent image holder, which causes a base fog, can also be suppressed.

According to this aspect of the invention, the electric field forming unit may form the toner fly electric field so as to cause the electric field strength exerted between the image portion on the surface of the latent image holder and the surface of the toner carrying roller to be higher than the contact toner fly start electric field strength. Accordingly, both the contact toner and the non-contact toner fly between the image portion and the surface of the toner carrying roller. Therefore, it is possible to develop the image portion with a sufficient developing density.

According to another aspect of the invention, there is provided an image forming apparatus including: a latent image holder that holds an electrostatic latent image in which an image portion to which toner is to be adhered and a non-image portion to which toner is not to be adhered have different potentials; a toner carrying roller that has a roller shape to be opposed to the latent image holder with a predetermined gap therebetween, and carries a toner layer including both the contact toner which directly contacts a surface of the roller and the non-contact toner which contacts the contact toner but does not contact the surface of the roller; and an electric field forming unit that forms an alternating electric field to cause the toner on a surface of the toner carrying roller to fly between the latent image holder and the toner carrying roller, as a toner fly electric field, wherein the non-contact toner is caused to fly, but the contact toner is not allowed to fly, between the non-image portion on the surface of the latent image holder and the surface of the toner carrying roller, at a position where the latent image holder and the toner carrying roller are opposed to each other.

According to still another aspect of the invention, there is provided an image forming method including: disposing a latent image holder that holds an electrostatic latent image and a toner carrying roller having a roller shape to be opposed to each other with a predetermined gap therebetween; forming an electrostatic latent image in which an image portion to which toner is to be adhered and a non-image portion to which toner is not to be adhered have different potentials, on a surface of the latent image holder; forming a toner layer including both the contact toner which directly contacts a surface of the roller and the non-contact toner which contacts the contact toner but does not contact the surface of the roller on a surface of the toner carrying roller to be transported to a position opposed to the latent image holder; forming an alternating electric field to cause toner on the surface of the toner carrying roller to fly between the latent image holder and the toner carrying roller, as a toner fly electric field, thereby developing the electrostatic latent image with the toner; and causing the non-contact toner to fly and the contact toner not to fly between the non-image portion on the surface of the latent image holder and the surface of the toner carrying roller, at a position where the latent image holder and the toner carrying roller are opposed to each other.

With such a configuration, similarly to the above-mentioned image forming apparatus, the contact toner is not allowed to fly between the non-image portion and the surface of the toner carrying roller. Therefore, it is possible to obtain a sufficient developing density while suppressing the base fog or the toner scattering and causing the non-contact toner to fly.

According to this aspect, both the contact toner and the non-contact toner may be caused to fly between the image portion on the surface of the latent image holder and the surface of the toner carrying roller, at the position where the latent image holder and the toner carrying roller are opposed to each other. Accordingly, similarly to the above-mentioned image forming apparatus, it is possible to develop the image portion with a sufficient developing density.

According to this aspect of the invention, the electric field forming unit may form an electric field to cause the time period for which an electric field having a polarity that causes the toner to fly in a direction from the latent image holder toward the toner carrying roller is generated to be longer than the time period for which an electric field having the reverse polarity is generated. Accordingly, the recovery of the toner which flies from the surface of the toner carrying roller once and is not be adhered to the image portion can be accelerated, thereby further suppressing the base fog or the toner scattering.

In addition, the toner carrying roller may be configured such that its surface for carrying the toner is made of a conductive material. With such a configuration, image force is strongly exerted between the conductive toner carrying roller and the toner contacting this, so that a property of the contact toner is that it is less likely to fly. Accordingly, it is difficult to reconcile a sufficient developing density and the suppression of the base fog and the toner scattering. When the configuration is applied to the apparatus, excellent results can be obtained.

In addition, the toner carrying roller may be provided with a concave portion formed by performing a rolling process on a surface of a metal tube. In addition, the toner carrying roller may be provided with a concave portion for accommodating the toner on a cylindrical surface, and the depth of the concave portion may be twice the volume average particle size of the toner or larger. Accordingly, two or more toner layers, on average, can be carried, on the concave portion. Therefore, the layer of the contact toner which directly contacts the surface of the toner carrying roller and the layer of the non-contact toner which contacts the layer of the contact toner but does not directly contact the surface of the toner carrying roller can be carried.

In addition, since the structure in which the toner is carried on the concave portion is employed, the non-contact toner can be properly carried. Since the binding force exerted on the non-contact toner toward the toner carrying roller is relatively small, the non-contact toner is likely to deviate from the surface of the toner carrying roller to scatter. However, the toner is carried while being accommodated into the concave portion, so that such a deviation can be suppressed.

In this case, the image forming apparatus may further include a restriction member that restricts the toner layer formed on the surface of the toner carrying roller other than the concave portion to be one toner layer or less. In addition, the image forming apparatus may further include a restriction member that restricts the carrying of the toner on the surface of the toner carrying roller other than the concave portion. Since the toner carried on the surface other than the concave portion is exposed on the surface of the toner carrying roller, the toner scatters easily. However, when one toner layer or less is allowed to directly contact the surface of the toner carrying roller, a deviation of the toner from the surface of the toner carrying roller can be suppressed by the strong binding force. Particularly, when the toner is allowed not to be carried on the surface other than the concave portion, the effect can be enhanced.

In addition, in the case using toner having a volume average particle size equal to or less than 5 μm, the apparatus is significantly effective. Since Coulomb force or van der Waals force is strongly exerted on the toner having a small particle size, the toner does not easily fly from the toner carrying roller. In addition, in order to obtain a sufficient developing density, a strong toner fly electric field is needed. Here, since the toner which has flown once has a small charge and a small mass, the toner escapes from the binding force exerted by the toner fly electric field and scatters easily. Accordingly, it is more difficult to reconcile a sufficient developing density and the suppression of the base fog and the toner scattering, as compared with the case of using toner having a high particle size. When the apparatus and method are applied to the case of using the toner having a small particle size, a sufficient developing density can be obtained while suppressing the generation of the base fog and the toner scattering. That is, a technique suitable for reducing the particle size of the toner is provided.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
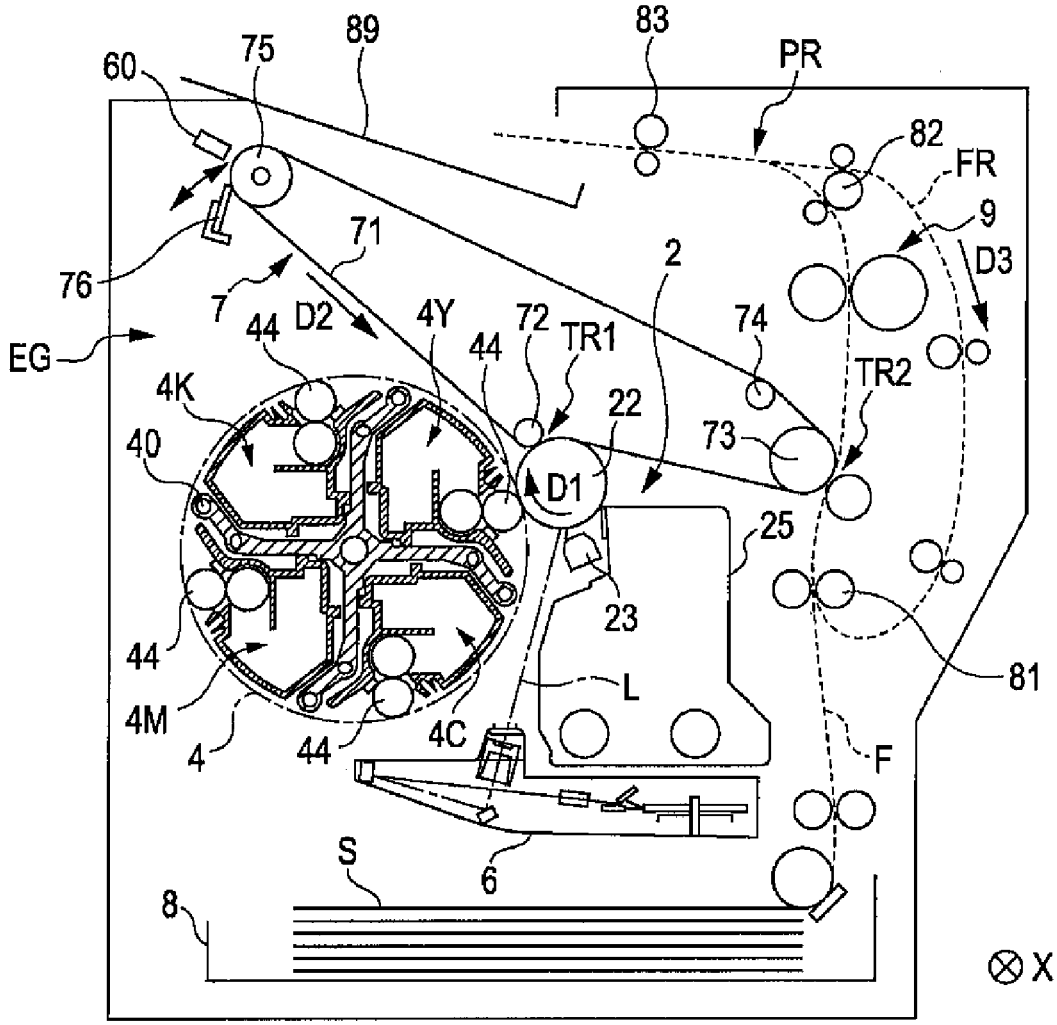
FIG. 1 is a diagram illustrating an image forming apparatus according to an embodiment of the invention.
Figure 2:
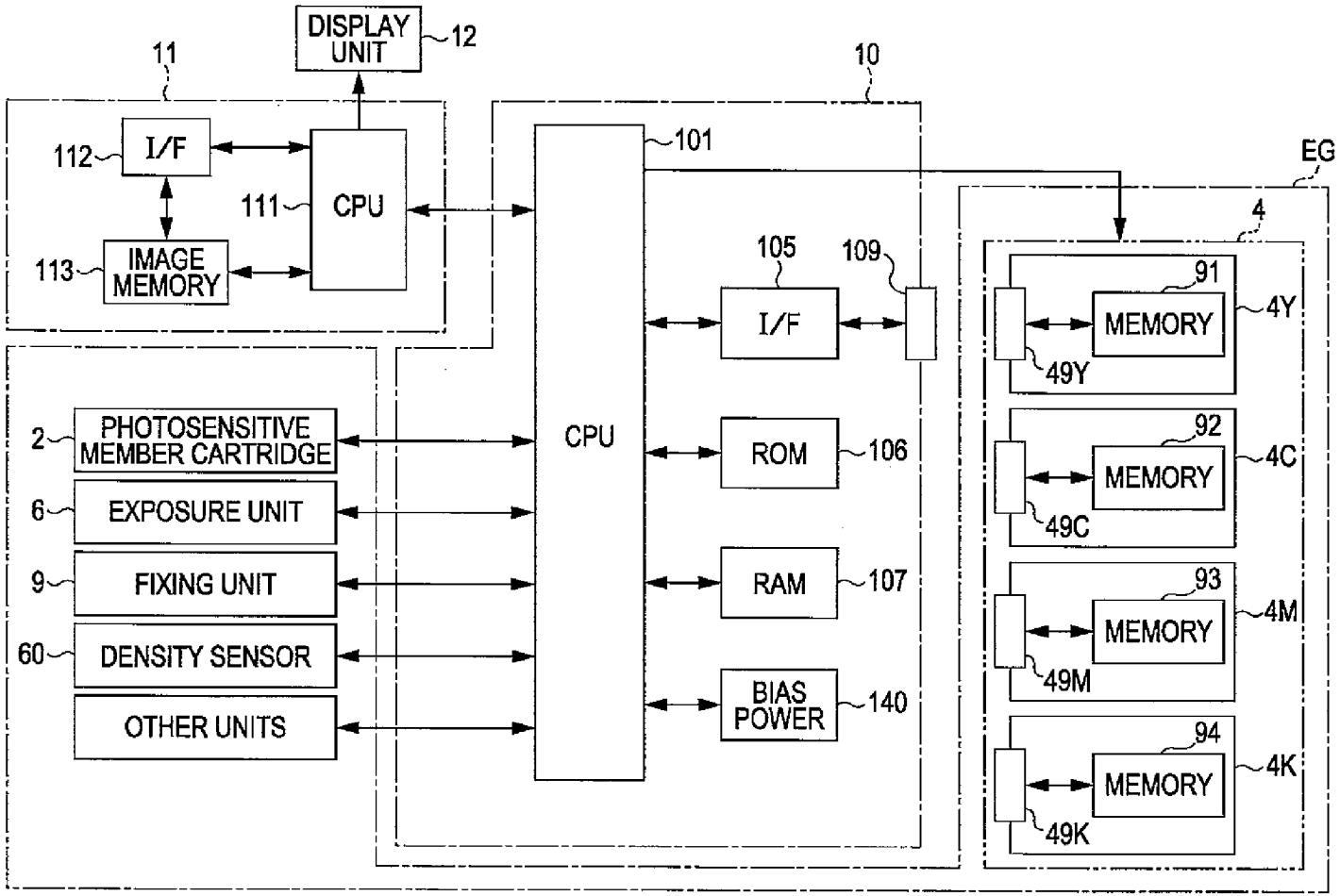
FIG. 2 is a block diagram illustrating an electrical configuration of the image forming apparatus of FIG. 1.

FIG. 1 is a diagram illustrating an image forming apparatus according to an embodiment of the invention. FIG. 2 is a block diagram illustrating an electrical configuration of the image forming apparatus of FIG. 1. This apparatus is an image forming apparatus for forming a full-color image by combining four color toners (developers); which are yellow (Y), cyan (C), magenta (M), and black (K), or forming a monochrome image using only a black (K) toner. In this image forming apparatus, when an image signal is input to a main controller 11 from an external apparatus such as a host computer, a CPU 101 of an engine controller 10 performs a predetermined image forming operation by controlling each unit in an engine unit EG according to a command from the main controller 11 and forms an image corresponding to the image signal on a sheet S.

In the engine unit EG, a photosensitive member 22 is provided to rotate in an arrow direction D1 of FIG. 1. In addition, around the photosensitive member 22, a charging unit 23, a rotary developing unit 4, and a cleaning unit 25 are disposed along the rotation direction D1. The charging unit 23 is applied with a predetermined charging bias to uniformly charge the outer peripheral surface of the photosensitive member 22 at a predetermined surface potential. The cleaning unit 25 removes residual toner adhered to the surface of the photosensitive member 22 after primary transfer so as to be collected in a waste toner tank provided therein. The photosensitive member 22, the charging unit 23, and the cleaning unit 25 constitute a photosensitive member cartridge 2, and the photosensitive member cartridge 2 formed in one body is mounted to be detachable from the main body of the apparatus.

In addition, a light beam L is emitted from an exposure unit 6 toward the outer peripheral surface of the photosensitive member 22 charged by the charging unit 23. The exposure unit 6 exposes the light beam L on the photosensitive member 22 according to an image signal given from the external apparatus to form an electrostatic latent image corresponding to the image signal.

The electrostatic latent image formed as described above is developed with toner by the developing unit 4. Specifically, in this embodiment, the developing unit 4 includes a supporting frame 40 which is provided to rotate on a rotation axis perpendicular to the sheet of FIG. 1, and a cartridge which is mounted to be detachable from the supporting frame 40 and includes a developer container 4Y for yellow, a developer container 4C for cyan, a developer container 4M for magenta, and a developer container 4K for black, which contain toners of the respective colors. The developing unit 4 is controlled by the engine controller 10. In addition, when the developing unit 4 is rotated and the positions of the developer containers 4Y, 4C, 4M, and 4K are selectively determined at predetermined development positions opposed to the photosensitive member 22 with a predetermined gap, on the basis of a control command from the engine controller 10, a developing roller 44 for carrying the toner with the selected color in the corresponding developer container is opposed to the photosensitive member 22, and the toner is applied to the surface of the photosensitive member 22 from the developing roller 44 at the opposed position. As a result, the electrostatic latent image on the photosensitive member 22 is developed in the selected toner color.

Figure 3:
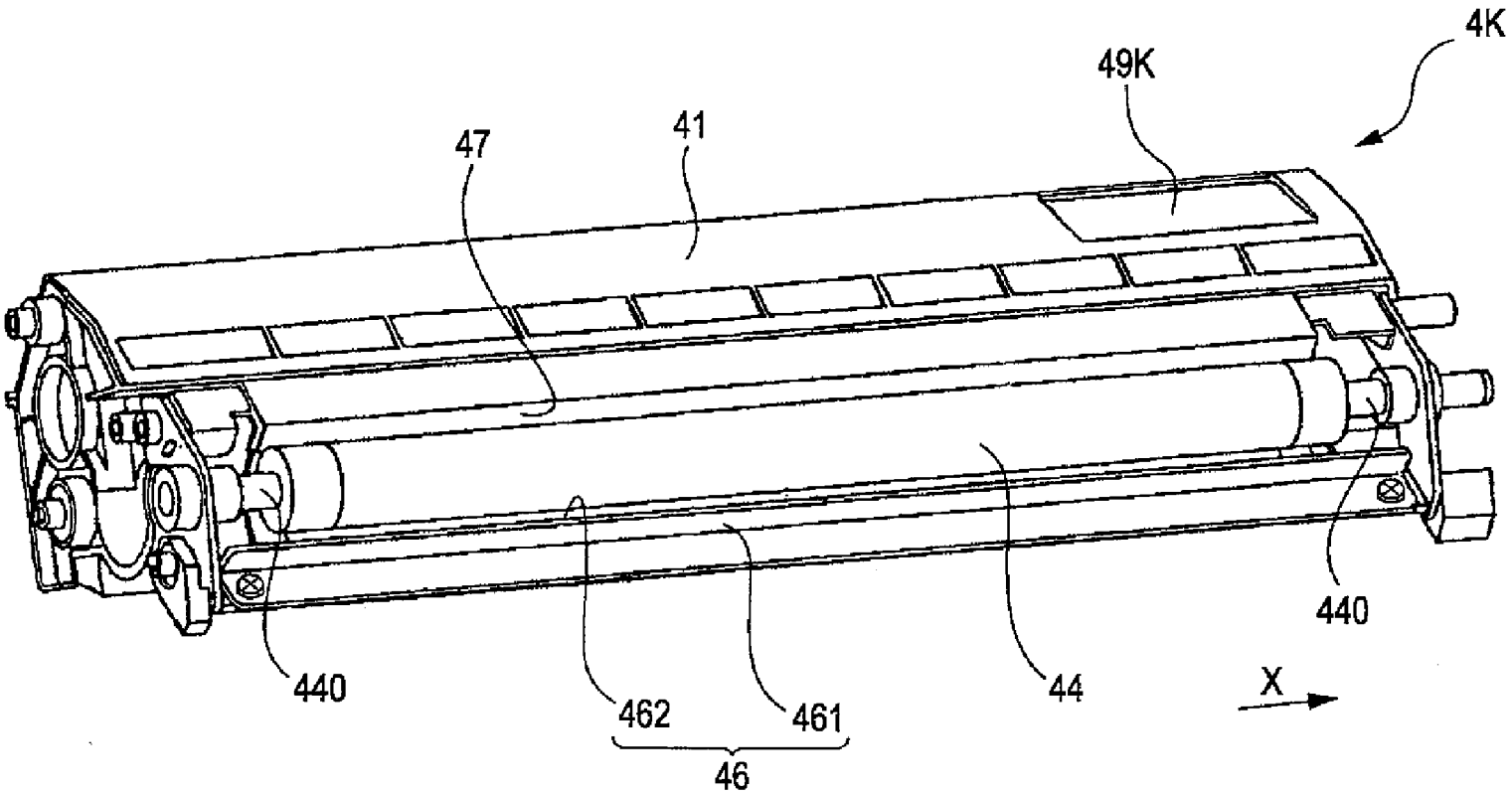
FIG. 3 is a diagram illustrating an outer appearance of a developer container.
Figure 4A:
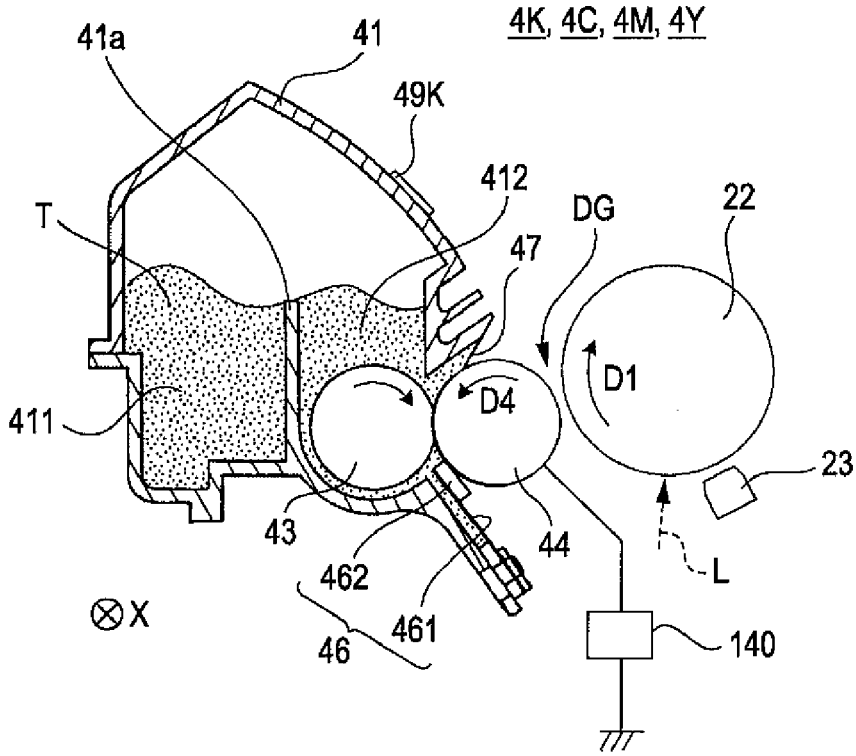
FIGS. 4A and 4B are diagrams illustrating a configuration of the developer container and a potential distribution of a photosensitive member.
Figure 4B:
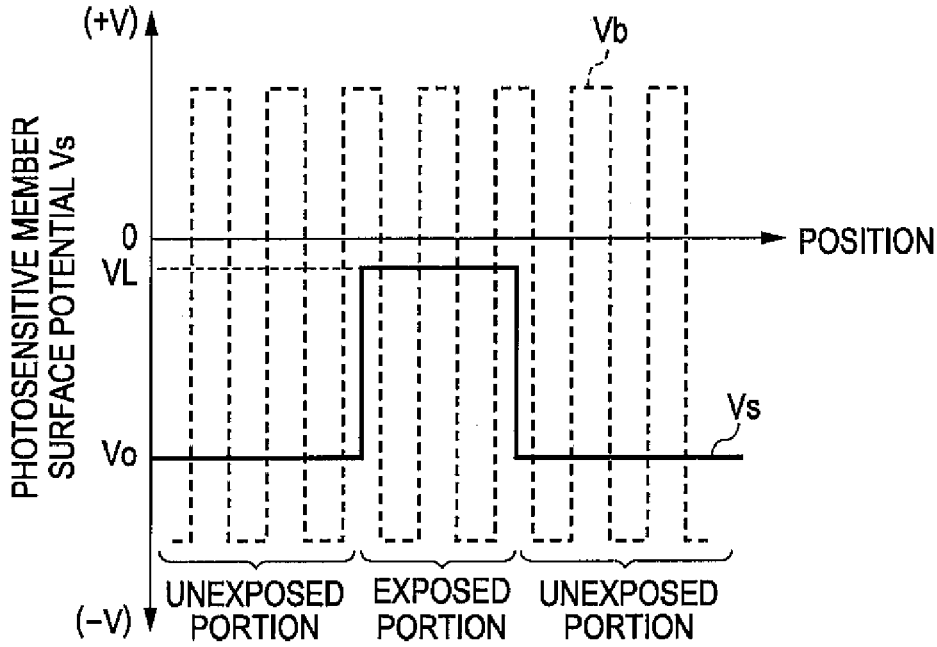

FIG. 3 is a diagram illustrating an outer appearance of the developer container. FIGS. 4A and 4B are diagrams illustrating a configuration of the developer container and a potential distribution of the photosensitive member. More specifically, FIG. 4A is a cross-sectional view illustrating the configuration of the developer container 4K, and FIG. 4B is a diagram illustrating an example of a potential distribution of the surface of the photosensitive material 22. The developer containers 4Y, 4C, 4M, and 4K have the same configuration. Therefore, hereinafter, although the configuration of only the developer container 4K is described in detail with reference to FIGS. 3 and 4A, the structure and the function thereof are the same as those of the other developer containers 4Y, 4C, and 4M.

In the developer container 4K, a supplying roller 43 and the developing roller 44 are attached to a housing 41 which contains a monocomponent toner T therein with axles. When the position of the developer container 4K is determined at the development position, the position of the developing roller 44 is determined at a position opposed to the photosensitive member 2 with a development gap DG, and the rollers 43 and 44 are engaged with a rotation driving unit (not shown) provided in the main body to be rotated in predetermined directions. The supplying roller 43 has the shape of a cylinder made of an elastic material such as urethane rubber foam or silicon rubber. The developing roller 44 has the shape of a cylindrical metal tube made of a conductive material, for example, metal such as copper, aluminum, or stainless or an alloy. As the two rollers 43 and 44 are rotated while contacting each other, toner is rubbed on the surface of the developing roller 44 to form a predetermined thickness of toner layer on the surface of the developing roller 44. In this embodiment, negatively charged toner is used. However, positively charged toner may be used, and in this case, the polarity of the potential of each unit has to be reversed.

The inner space of the housing 41 is partitioned into a first chamber 411 and a second chamber 412 by a barrier 41*a*. The supplying roller 43 and the developing roller 44 are provided in the second chamber 412. With the rotation of the rollers, the toner in the second chamber 412 is caused to fly and agitated to be supplied to the surface of the developing roller 44. On the other hand, since the toner stored in the first chamber 411 is isolated from the supplying roller 43 and the developing roller 44, the toner is not caused to fly by the rotation of the rollers. This toner is agitated and mixed with the toner stored in the second chamber 412 as the developing unit 4 is rotated while holding the developer container.

As described above, in this developer chamber, the inside of the housing is divided into the two chambers, and the second chamber 412, which has a relatively small capacity and which is constituted by side walls of the housing 41 and the barrier 41*a* to surround the supplying roller 43 and the developing roller 44, is provided. As a result, even when the residual toner is reduced, it is possible to effectively supply the toner to the vicinity of the developing roller 44. In addition, the supplying of the toner from the first chamber 411 to the second chamber 412 and the agitating of the entire toner are caused by the rotation of the developing unit 4. Accordingly, an augerless structure without an agitating member (auger) for agitating the toner inside the developer container can be implemented.

In addition, in the developer container 4K, a restriction blade 46 for restricting the thickness of a toner layer formed on the surface of the developing toner 44 to be a predetermined thickness is disposed. The restriction blade 46 includes a plate-like member 461 having elasticity, which is made of stainless, phosphor bronze, or the like, and an elastic member 462 that is a resin member made of silicon rubber, urethane rubber, or the like and mounted to a front end portion of the plate-like member 461. The rear end portion of the plate-like member 461 is fixed to the housing 41, and the elastic member 462 fixed to the front end portion of the plate-like member 461 is disposed on the upstream side from a rear end portion of the plate-like member 461 in the rotation direction D4 of the developing roller 44 shown as an arrow of FIG. 4. The elastic member 462 elastically contacts the surface of the developing roller 44 to form a restriction nipple thereby finally restricting a toner layer formed on the surface of the developing roller 44 to have a predetermined thickness. The surface structure of the developing roller 44 will be described later in detail.

The toner layer formed on the surface of the developing roller 44 as described above is sequentially transported to the position opposed to the photosensitive member 2 having an electrostatic latent image on its surface, with the rotation of the developing roller 44. Then, a developing bias from a bias power 140 controlled by the engine controller 10 is applied to the developing roller 44. As illustrated in FIG. 4B, in regard to the surface potential Vs of the photosensitive member 22, after the photosensitive member 22 is uniformly charged by the charging unit 23, the potential VL of an exposed portion illuminated with the light beam L from the exposure unit 6 is decreased to about the residual potential of the photosensitive member 22, and an unexposed portion that is not illuminated with the light beam L has a substantially uniform potential Vo. The developing bias Vb given to the developing roller 44 is a rectangular-wave alternating-current voltage. As the developing bias Vb is applied, the toner carried on the developing roller 44 flies in the development gap DC to be partially adhered to the corresponding portions on the surface of the photosensitive member 22 depending on the surface potential Vs. As a result, the electrostatic latent image on the photosensitive member 22 is developed as a toner image with the corresponding toner colors. In the description, it is assumed that the image forming apparatus is of a general negative latent image type, that is, a type in which toner is adhered to portions from which charges are removed by exposure.

The housing 41 is provided with a seal member 47 that comes in pressing contact with the surface of the developing roller 44 on the downstream side from the position opposed to the photosensitive member 22 in the rotation direction of the developing roller 44. The seal member 47 is made of a flexible material such as polyethylene, nylon, or fluororesin, and is a band-like film expanding in a direction X parallel with the axis of rotation of the developing roller 44. One end portion thereof in a lateral direction perpendicular to the longitudinal direction X is fixed to the housing 41, and the other end portion contacts the surface of the developing roller 44. The other end portion contacts the developing roller 44 in a so-called trail direction toward the downstream in the rotation direction D4 of the developing roller 44, and guides toner that passes the position opposed to the photosensitive member 22 and remains on the surface of the developing roller 44 to the inside of the housing 41 and prevents the toner in the housing from leaking.

Returning to FIG. 1, description of the image forming apparatus is continued. The toner image developed by the developing unit 4 as described above, is primarily transferred on an intermediate transfer belt 71 of a transfer unit 7 in a primary transfer region TR1. The transfer unit 7 includes the intermediate transfer belt 71 hung on plural rollers 72 to 75 and a driving unit (not shown) to cause the intermediate transfer belt 71 to rotate in a predetermined rotation direction D2 by rotating the roller 73. In the case of transferring a color image on a sheet S, toner images having respective colors formed on the photosensitive member 22 overlap on the intermediate transfer belt 71 to form the color image, sheets are taken out of the cassette 8 one by one to be transported to a secondary transfer region TR2 along a transport path F, and the color image is transferred onto the transported sheet S a second time.

Here, in order for the image on the intermediate transfer belt 71 to be accurately transferred to a predetermined position on the sheet S, the timing for sending the sheet S to the secondary transfer region TR2 is managed. Specifically, a gate roller 81 is provided on the front side of the secondary transfer region TR2 in the transport path F, and as the gate roller 81 rotates at a timing corresponding to a revolving movement of the intermediate transfer belt 71, the sheet S is transported to the secondary transfer region TR2 at a predetermined timing.

In addition, the toner image is fixed to the sheet S on which the color image is formed as described above, by the fixing unit 9. Then, the sheet S is transported to a discharge tray 89 provided on the top portion of the main body of the apparatus via a pre-discharge roller 82 and a discharge roller 83. In addition, in the case where images are formed on both the surfaces of the sheet S, at a time point at which a rear end portion of the sheet S where the image is formed on one of the surfaces as described above is transported to a reverse position PR in the rear of the pre-discharge roller 82, the rotation direction of the discharge roller 83 is reversed, and correspondingly the sheet S is transported in a direction shown as an arrow D3 along a reverse transport path FR. Then, the sheet S is transported on the transport path F again in front of the gate roller 81. Here, the surface of the sheet S which contacts the intermediate transfer belt 71 to allow an image to be transferred thereto in the secondary transfer region TR2 is a surface opposite to the surface to which the image is primarily transferred. As described above, images can be formed on both the surfaces of the sheet S.

As illustrated in FIG. 2, the developer containers 4Y, 4C, 4M, and 4K have memories 91, 92, 93, and 94, respectively, for storing data about production lot, usage, amount of residual toner, and the like. In addition, the developer containers 4Y, 4C, 4M, and 4K are provided with wireless communicators 49Y, 49C, 49M, and 49K, respectively. As needed, they selectively perform data communication without being in contact with a wireless communicator 109 provided in the main body, and transmit/receive data between the CPU 101 and the memories 91 to 94 via an interface 105 to manage various types of information on expendable supply management and the like, for the developer containers. In this embodiment, data transmission/reception is performed without contact by using an electronic means such as wireless communication. However, connectors or the like may be provided to the main body and each of the developer containers such that the connectors are mechanically fitted to perform data transmission/reception with each other.

As illustrated in FIG. 2, the apparatus includes a display unit 12 controlled by the CPU 111 of the main controller 11. The display unit 12 is configured as, for example, a liquid crystal display and displays a predetermined message to explain to the user how to perform manipulation, the status of an image forming operation, errors in the apparatus, the time for the replacement of a unit, and the like, depending on a control command from the CPU 111.

In FIG. 2, reference numeral 113 denotes an image memory provided in the main controller 11 for storing an image given from an external apparatus such as a host computer via the interface 112. Reference numeral 106 denotes a ROM for storing operation programs executed by the CPU 101, control data used for controlling the engine unit EG, and the like. Reference numeral 107 denotes a RAM for temporarily storing the operational results of the CPU 101 and other data.

In the vicinity of the roller 75, a cleaner 76 is disposed. The cleaner 76 can be moved to be close to or distant from the roller 75 by an electronic clutch not shown. In addition, in the state where the cleaner 76 is moved toward the roller 75, a blade of the cleaner 76 contacts the surface of the intermediate transfer belt 71 hung on the roller 75, and removes the residual toner adhered to the outer peripheral surface of the intermediate transfer belt 71 after the secondary transfer.

In the vicinity of the roller 75, a density sensor 60 is disposed. The density sensor 60 is opposed to the surface of the intermediate transfer belt 71 and measures an image density of a toner image formed on the outer peripheral surface of the intermediate transfer belt 71 as needed. In addition, on the basis of the measurement result, in this apparatus, operation conditions of each unit which may have an effect on image quality, for example, a developing bias applied to each developer container, intensity of the exposure beam L, tone correction characteristics of the apparatus, and the like, are adjusted.

The density sensor 60 outputs a signal corresponding to the shade of a region having a predetermined size on the intermediate transfer belt 71 by using, for example, a reflective photosensor. The CPU 101 periodically samples the output signal from the density sensor 60 while revolving the intermediate transfer belt 71, thereby detecting the image density of each portion of the toner image on the intermediate transfer belt 71.

Next, in the image forming apparatus having the above-mentioned configuration, specifically, in the image forming apparatus of a so-called AC jumping phenomenon type in which a photosensitive member and a developing roller are opposed to each other with a gap therebetween and an alternating electric field is generated in the gap therebetween to cause toner to fly, a desirable relationship between the surface potential of the photosensitive member 22 and the developing bias Vb will be described. The inventors have found the solution to problems in the image forming apparatus, such as the degradation of a developing density caused by the small toner particle size, a base fog, and toner scattering, by allowing the toner layer carried on the surface of the developing roller 44 to be two or more toner layers and suitably setting the potential of an electrostatic latent image and the potential of a developing bias. Hereinafter, the finding will be described.

Figure 5:
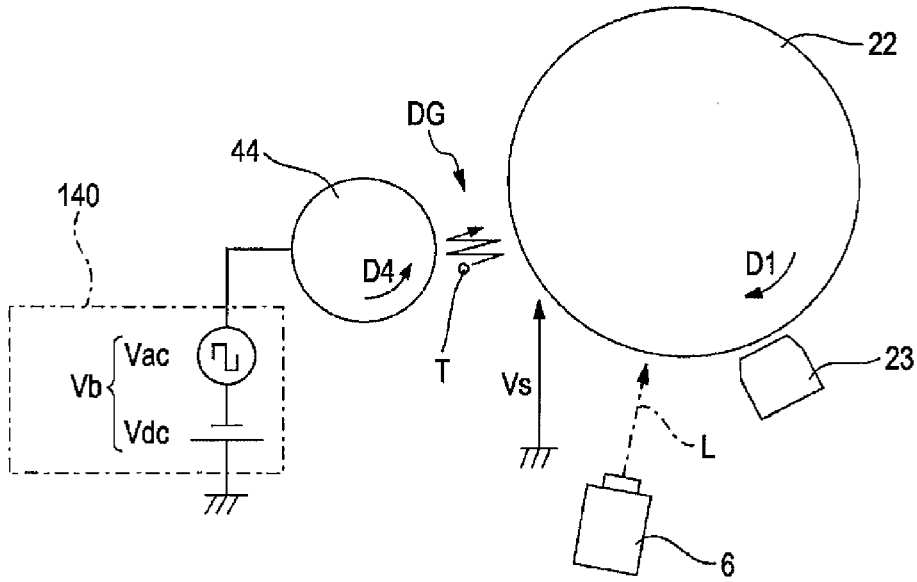
FIG. 5 is a diagram schematically illustrating a main section of the image forming apparatus of FIG. 1.
Figure 6:
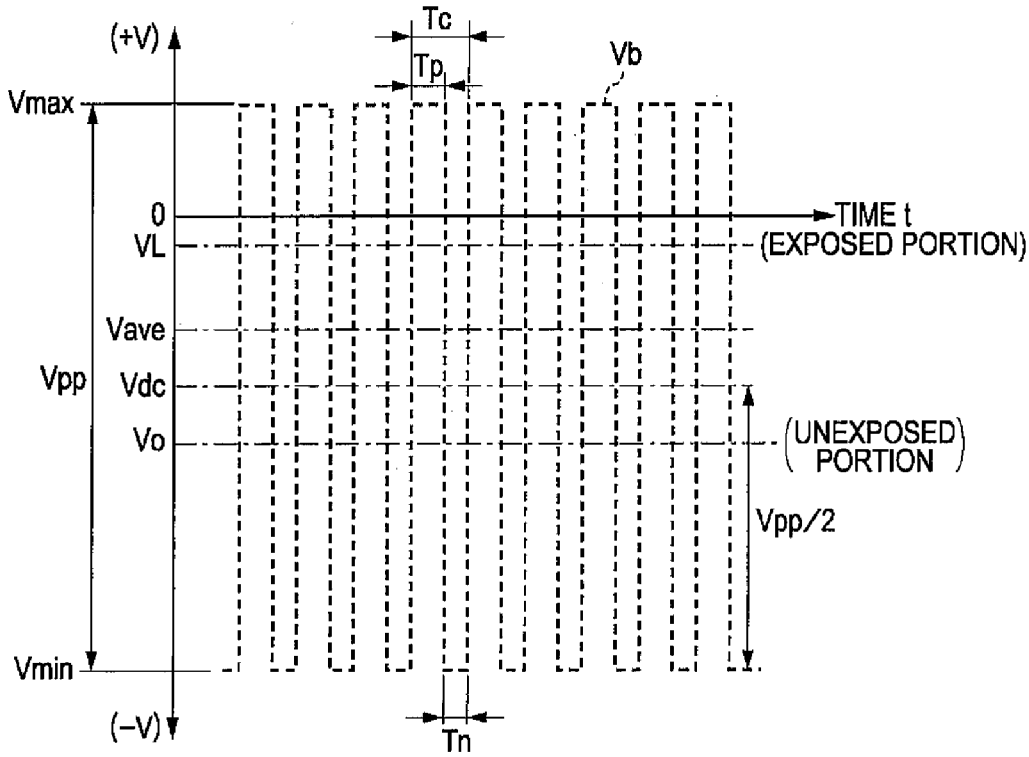
FIG. 6 is a diagram illustrating an example of a potential of each unit in the configuration of FIG. 5.

FIG. 5 is a diagram schematically illustrating the main section of the image forming apparatus of FIG. 1. FIG. 6 is a diagram illustrating an example of a potential of each unit in the configuration of FIG. 5. In the image forming apparatus, as illustrated in FIG. 5, the photosensitive member 22 is uniformly charged at a predetermined surface potential by the charging unit 23. In addition, the exposure unit 6 exposes the surface of photosensitive member 22 to form an electrostatic latent image on the surface of the photosensitive member 22 in response to an image signal. The surface potential Vs of the photosensitive member 22 in the vicinity of the development gap DG is VL at an exposed portion and Vo at an unexposed portion as described above.

The surface of the developing roller 44 opposed to the photosensitive member 22 with the development gap DG therebetween, carries a toner layer and is applied with the developing bias Vb from the bias power 140. As illustrated in FIG. 5, the developing bias Vb is generated by overlapping an alternating current voltage Vac and a direct current voltage Vdc, and as illustrated in FIG. 6, the direct current voltage Vac is a rectangular-wave voltage. The amplitude (voltage between peaks) is denoted by Vpp. Therefore, the instantaneous value of the developing bias Vb changes between ±(Vpp/2) from the direct current voltage Vdc. The positive maximum value and the negative maximum value of the developing bias Vb are denoted by Vmax and Vmin, respectively.

In a repetition period Tc of the alternating current component Vac of the developing bias Vb, a period for which the potential is positive is denoted by symbol Tp, and a period for which the potential is negative is denoted by symbol Tn. The waveform duty cycle WD of the developing bias Vb is defined by:

$$WD=Tp/(Tp+Tn)=Tp/Tc.$$

As described later, in this embodiment, a bias waveform is determined such that Tp>Tn, that is, the waveform duty cycle WD is greater than 50%. Therefore, an effective average of the developing bias Vb including the waveform duty cycle, that is, a weighted average voltage Vave is not necessarily equal to the direct current component Vdc of the developing bias Vb, and in this embodiment, the weighted average voltage Vave has a value closer to a zero potential than the direct current component Vdc.

A potential difference between the weighed average voltage Vave of the developing bias Vb and the potential VL of the exposed portion on the surface of the photosensitive member 22 is a so-called "development contrast voltage", and this is a parameter that has a significant effect on the developing density. In addition, an electric field formed in the vicinity of the surface of the developing roller 44, which is caused by the potential difference between the surface of the photosensitive member 22 and the surface of the developing roller 44 which are opposed to each other in the development gap DG, has a function of causing toner carried on the surface of the developing roller 44 to fly.

Specifically, when the strength of the electric field formed in the development gap DG, which is caused by the potential difference between the surface of the developing roller 44 and the surface of the photosensitive member 22, is at a predetermined level or higher, as denoted by symbol T of FIG. 5, Coulomb force exerted on the toner carried on the surface of the developing roller 44 from the electric field is higher than adhesion to the developing roller 44, so that the toner flies from the surface of the developing roller 44. In the case where negatively-charged toner is used, when the developing bias Vb applied to the developing roller 44 has a negative value Vmin, an electric field having a polarity that causes the toner to be detached from the surface of the developing roller 44 is generated in the development gap DG. In addition, due to the operation of the alternating electric field, the toner reciprocates in the development gap DC. In the specification, the electric field formed to cause the toner to fly in the development gap DG is called the "toner fly electric field".

Here, an electric field strength needed to cause the toner to fly from the developing roller 44 is described. In addition, in the following description, a minimum electric field strength needed to cause the toner to fly from the surface of the developing roller 44 is called the "fly start electric field strength".

Figures 7A, 7B:
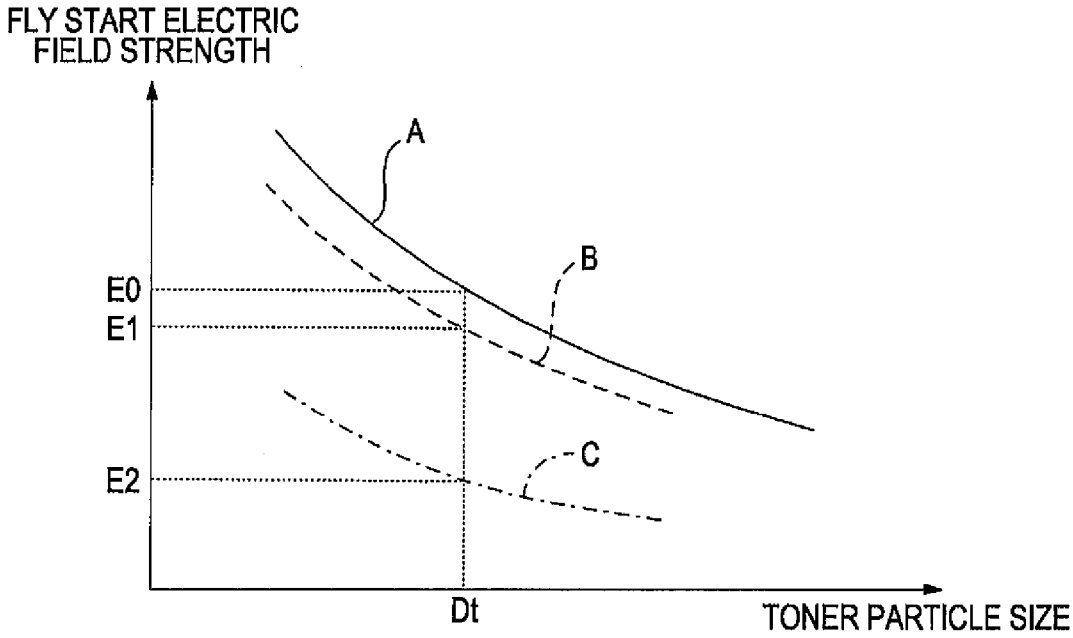
FIGS. 7A and 7B are diagrams illustrating a measurement result of a relationship between a toner particle size and a fly start electric field strength.

FIGS. 7A and 7B are diagrams illustrating a measurement result of a relationship between a toner particle size and a fly start electric field strength. More specifically, FIG. 7A is a diagram illustrating changes in the fly start electric field strength according to toner particle size, and FIG. 7B is a diagram illustrating an example of an actual measurement value of the fly start electric field strength. In addition, a detailed method of measuring the fly start electric field strength will be described later. In FIG. 7A, a curve A shown as a solid line is an actual measurement result of the fly start electric field strength (hereinafter, referred to as the "single layer toner fly start electric field strength") in the case where one toner layer or less is carried on the surface of the developing roller 44. The smaller a toner particle size is, the higher the fly start electric field strength is. It is thought that this is because the surface area or charge per mass is larger as the toner particle size is smaller, and adhesion to the surface of the developing roller 44 is increased.

In addition, a curve B shown as a dashed line and a curve C shown as a dot-dashed line represent actual measurement results in the case where two toner layers are carried as the toner layer on the surface of the developing roller 44. In the case where two layers, and more strictly, more than one layer is carried as the toner layer on the surface of the developing roller 44, not all of the toner stays in contact with the surface of the developing roller 44, but some of the toner comes into contact with the toner contacting the surface of the developing roller 44 and is indirectly carried on the developing roller 44. The inventors have found that the behavior difference between the two types of toner has a significant effect on the characteristics of a developing operation. In the following description, in order to distinguish therebetween, in the toner of the toner layers, the toner directly contacting the developing roller 44 is called "contact toner (symbol T1)" and the toner which does not directly contact the developing roller 44 but contacts the contact toner to be carried on the developing roller 44 is called the "non-contact toner (symbol T2)".

The curve B shown in FIG. 7A represents a fly start electric field strength (hereinafter, referred to as the "contact toner fly start electric field strength") for the contact toner. In addition, the curve C represents a fly start electric field strength (hereinafter, referred to as a "non-contact toner fly start electric field") for the non-contact toner. They can be individually measured, and a measurement method thereof will be described in detail.

As shown by the curves B and C of FIG. 7A, in the case of the two layers as the toner layer, the fly start electric field strength is also increased as the toner particle size is smaller. In addition, the contact toner fly start electric field strength (curve B) is lower than the single layer toner fly start electric field strength (curve A), and the non-contact toner fly start electric field strength (curve C) is lower than the contact toner fly start electric field strength (curve B). In addition, in the following description, in regard to toner having a volume average particle size of a value Dt, a single layer toner fly start electric field strength, a contact toner fly start electric field strength, and a non-contact toner fly start electric field strength are denoted by symbols E0, E1, and E2, respectively.

As an numerical example for actual measurement, actual measurement results of a single layer toner fly start electric field strength E0, a contact toner fly start electric field strength E1, and a non-contact toner fly start electric field strength E2 when measurement is performed using toner having a volume average particle size Dt of 4.5 μm are shown in FIG. 7B. The reason why the results were obtained will be described as follows.

Figure 8A:
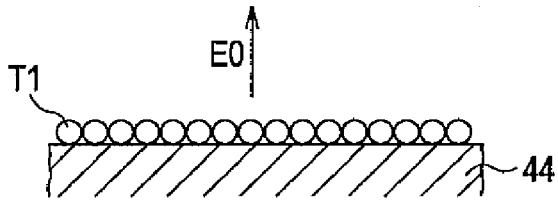
FIGS. 8A to 8D are diagrams illustrating a behavior on the surface of a developing roller when an electric field is applied.

FIGS. 8A to 8D are diagrams illustrating a behavior on the surface of the developing roller when an electric field is applied. When the toner layer carried on the surface of the developing roller 44 is one toner layer, as described above, the toner directly contacts the surface of the developing roller 44 and is strongly bound thereto. Therefore, as illustrated in FIG. 8A, if an electric field E0 is not strong enough, the toner does not fly.

Figure 8B:
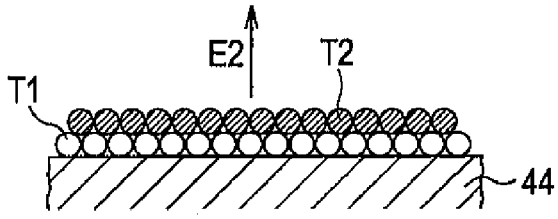

On the other hand, when the toner layer carried on the surface of the developing roller 44 is more than one toner layer, as illustrated in FIG. 8B, in addition to contact toner T1 (shown as white circles) directly contacting the surface of the developing roller 44, non-contact toner T2 (shown as hatched circles) which contacts the contact toner but does not directly contact the surface of the developing roller 44 exists. The binding force exerted on the non-contact toner T2 from the surface of the developing roller 44 is small. Therefore, the electric field strength (non-contact toner fly start electric field strength) E2 needed to cause the non-contact toner T2 to fly from the developing roller 44 may be smaller than the fly start electric field strength E0 in the case of the one toner layer as the toner layer, by a great deal.

Here, even in the case where there is more than one toner layer carried on the surface of the developing roller 44, the toner (contact toner) T1 directly contacting the surface of the developing roller 44 is exerted with the same binding force as that of the toner in the case of the one toner layer as the toner layer from the developing roller 44. Therefore, simply, it is thought that the toner T1 does not fly if the strength of the applied electric field is not equal to or higher than the single layer toner fly start electric field strength E0.

Figure 8C:
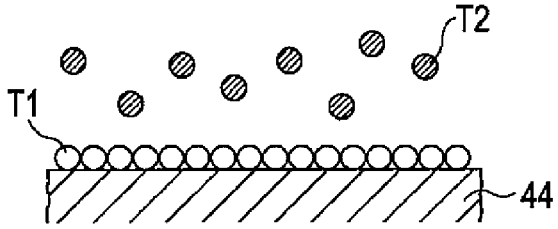
Figure 8D:
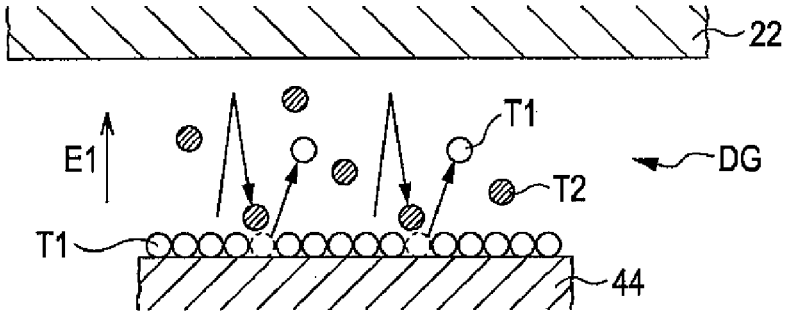

However, in this case, unlike the case of the one toner layer as the toner layer, as illustrated in FIG. 8C, the non-contact toner T2 that flies due to a weaker electric field exists in the vicinity of the surface of the developing roller 44. The toner that flies as described above reciprocates by the alternating electric field to be accelerated. As a result, the toner obtains enough kinetic energy, and as illustrated in FIG. 8D, collides with the contact toner T1 on the developing roller 44 to be bounced back, resulting in the contact toner T1 flying. Specifically, as the non-contact toner T2 starts flying in the weaker electric field, the contact toner T1 can fly even in an electric field weaker than the single layer toner fly start electric field strength E0. It is thought that, for this reason, the contact toner fly start electric field strength E1 becomes smaller than the single layer toner fly start electric field strength E0.

As described above, in the case where more than one toner layer is carried on the surface of the developing roller 44, it is possible to allow the toner to fly in a weaker electric field than that in the case of one toner layer or less as the toner layer. In other words, carrying more than one toner layer on the surface of the developing roller 44 makes it possible to reduce the electric field strength needed for guaranteeing that the necessary amount of toner will fly in the development gap DG. In addition, herein, it is described that "more than one toner layer is carried on the surface of the developing roller 44". However, more strictly, in principle, this is not a problem regarding the thickness of the toner layers, but, more importantly, a point that "toner layers including both the contact toner and the non-contact toner are carried on the surface of the developing roller 44".

In addition, according to the research of the inventors, there is a tendency that toner functioning as the contact toner generally has a high charge, and toner functioning as the non-contact toner has a relatively low charge. It is thought that this phenomenon occurs because the toner having a higher charge is pulled toward the developing roller by a greater force, but the toner having a smaller charge is pushed away by the former toner from the vicinity of the surface of the developing roller. Practically, it has proved that a behavior difference between the contact toner and the non-contact toner is significant in the case where the surface of the developing roller is formed of a conductive material such as metal. It is thought that this is because a strong image force is exerted between the material having high conductivity and the toner having a high charge.

In addition, as described later, by actively using the flight behavior difference between the contact toner and the non-contact toner, it is possible to reconcile the improvement in developing density with the suppression of a base fog or toner scattering. First, for the comparison, toner behavior in the case of one toner layer or less as the toner layer is described.

Figure 9:
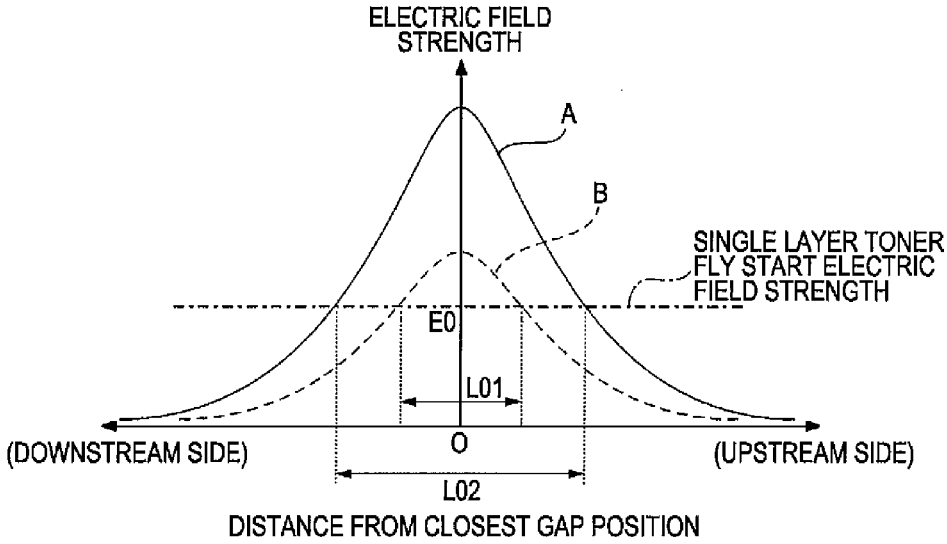
FIG. 9 is a diagram illustrating an electric field strength distribution when the number of toner layers is one layer or less.

FIG. 9 is a diagram illustrating an electric field strength distribution when the toner layer is one layer or less. In the graph of FIG. 9, the horizontal axis represents the surface position of the developing roller 44 when viewed from the rotation shaft of the developing roller 44 to the development gap DG. Specifically, in the development gap DG where the photosensitive member 22 and the developing roller 44, each of which has a substantially cylindrical shape, are opposed to each other, the position where the two are closest to each other is determined as the origin O. Each position on the peripheral surface of the developing roller 44 is represented by a distance from the origin O. The vertical axis represents the electric field strength of an electric field when a polarity of the electric field (toner fly electric field) at each portion becomes a polarity that causes the toner to fly from the surface of the developing roller 44. This can also be applied to FIGS. 10 to 11C described later.

A value obtained by dividing a potential difference between the photosensitive member 22 and the developing roller 44 by the size of the gap at each position is the electric field strength at the corresponding position. However, since an exposed portion and an unexposed portion on the surface of the photosensitive member 22 have different surface potentials as described above, the electric field strength at each position on the surface of the developing roller 44 is different depending on whether the position is opposed to the exposed portion or the unexposed portion on the photosensitive member 2. As can be seen from FIG. 6, an electric field strength on the surface of the developing roller 44 opposed to the exposed portion of the photosensitive member 22 is a value obtained by dividing a difference between the photosensitive member surface potential VL and the developing bias potential Vmin by the size of a gap. In addition, an electric field strength on the surface of the developing roller 44 opposed to the unexposed portion of the photosensitive member 22 is a value obtained by dividing a difference between the photosensitive member surface potential Vo and the developing bias potential Vmin by the size of a gap.

As can be seen from the relationship of FIG. 6, at a position on the surface of the developing roller 44 opposed to the exposed portion of the photosensitive member 22, the electric field strength is higher than that at a position opposed to the unexposed portion. In addition, the electric field strength is at the maximum at the position where the photosensitive member 22 and the developing roller 44 are closest to each other, and the electric field strength is decreased with distance from the closest position. A curve A shown as a solid line in FIG. 9 represents the electric field strength of an electric field (hereinafter, referred to as an "exposed portion electric field") at a position opposed to the exposed portion on the photosensitive member 22. In addition, a curve B shown as a dashed line represents the electric field strength of an electric field (hereinafter, referred to as an "unexposed portion electric field") at a position opposed to the unexposed portion on the photosensitive member 22.

In order to cause the toner to fly in the development gap DG, the electric field strength of the toner fly electric field at the closest gap position has to be higher than the single layer toner fly start electric field strength E0. More specifically, the electric field strength of the unexposed portion electric field has to be higher than the single layer toner fly start electric field strength E0. If not, the toner does not fly from the surface of the developing roller 44 opposed to the unexposed portion, and a sufficient amount of flying toner cannot be obtained.

Here, a range in which the electric field strength is equal to or higher than the single layer toner fly start electric field strength is a region causing the toner to fly, and the width thereof can be referred to as the effective development gap width. As can be seen from FIG. 9, a development gap width L01 at the position opposed to the unexposed portion of the photosensitive member 22 is different from a development gap width L02 at the position opposed to the exposed portion, and the development gap width L01 at the position opposed to the unexposed portion is much narrower than the development gap width L02 at the position opposed to the exposed portion. This means that the reciprocating frequency of the toner that flies in the vicinity of the unexposed portion of the photosensitive member 22 is a great deal smaller than the reciprocating frequency of the toner that flies in the vicinity of the exposed portion.

In the AC jumping phenomenon type, toner flies and reciprocates many times in the development gap to obtain a sufficient developing density and a good image contrast. Particularly, the point that the reciprocating frequency of the toner in the unexposed portion is small and the electric field strength thereof is low means that there is a high possibility that toner adhered to the unexposed portion that is not a region to which toner is to be adhered cannot be moved back to the developing roller 44. The toner adhered to the unexposed portion as described above remains on the developed toner image to act as a base fog.

In general, it is recognized that a fogging phenomenon occurs when toner charged with a polarity reverse to the original charge polarity (negative charge in this embodiment) or toner having a very small charge is adhered to the unexposed portion. According to research on a transfer bias applied when the toner image developed on the photosensitive member 22 is transferred to another transfer medium (an intermediate transfer member or a recording medium), it is possible to prevent this type of toner from being transferred to a transfer medium. However, according to the research by the inventors, since the reciprocating frequency is small, the phenomenon in which the toner remains on the unexposed portion occurs regardless of the charge polarity of the toner, and in some cases, toner charged with the original charge polarity is adhered to and remains on the unexposed portion. The base fog caused by the toner cannot be prevented during transfer.

In addition, in order to prevent unnecessary toner to being adhered to the unexposed portion, or to detach the adhered toner, a technique for adjusting a waveform duty cycle of the developing bias as applied in this embodiment is known. However, it is difficult to reconcile sufficient developing density with the suppression of the base fog.

In addition, as described above, in order to obtain a sufficient amount of toner flying in the development gap DG at a point where the single layer toner fly start electric field strength E0 is relatively high, it is necessary to generate a relatively strong toner fly electric field in the development gap DG. This strong electric field gives high kinetic energy to the toner flying, so that toner scattering occurs easily in the inside or outside of the apparatus.

As described above, in the apparatus configured to carry one toner layer or less on the surface of the developing roller, it is difficult to reconcile sufficient developing density and the suppression of the base fog and the toner scattering. Particularly, when the toner is made to have a small particle size, the above-mentioned problem becomes significant as illustrated in FIG. 7A, because the toner fly start electric field is increased as the toner particle size is smaller.

Next, the behavior of the toner in the case where more than one toner layer is carried on the surface of the developing roller will be described. In this case, since the contact toner and the non-contact toner are carried on the surface of the developing-roller, two toner fly start electric field strengths, that is, a contact toner fly start electric field strength E1 and a non-contact toner fly start electric field strength E2 exist (E1>E2). Therefore, the behavior of the toner is determined by the two types of fly start electric field strength, and the relationship between the electric field strengths of the exposed portion electric field and the unexposed portion electric field.

Figure 10:
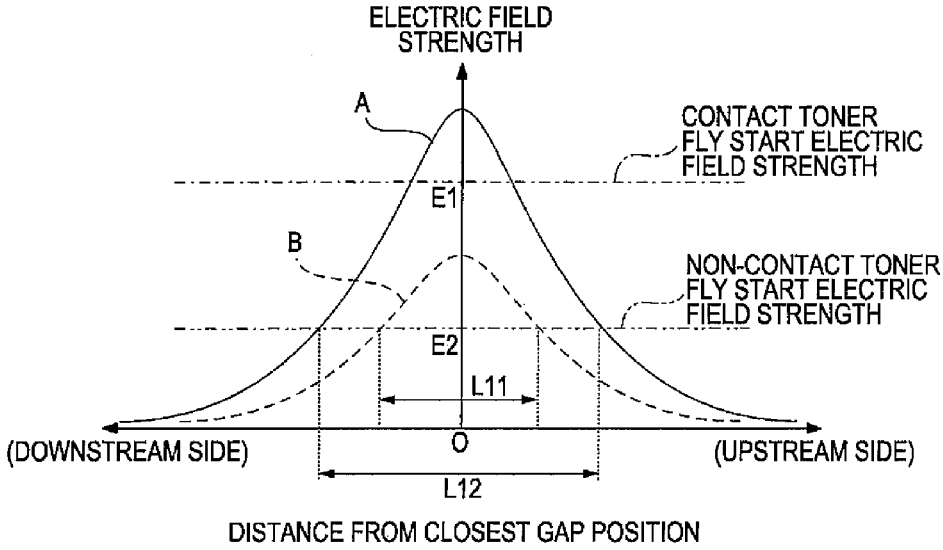
FIG. 10 is a diagram illustrating an electric field strength distribution of a development gap according to the embodiment.
Figure 11A:
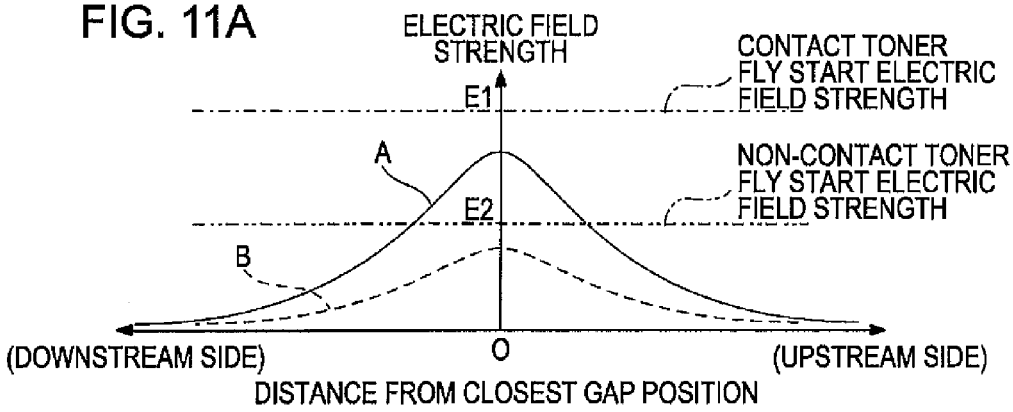
FIGS. 11A to 11C are diagrams illustrating Comparative Examples of an electric field strength distribution when the number of toner layers is more than one layer.
Figure 11B:
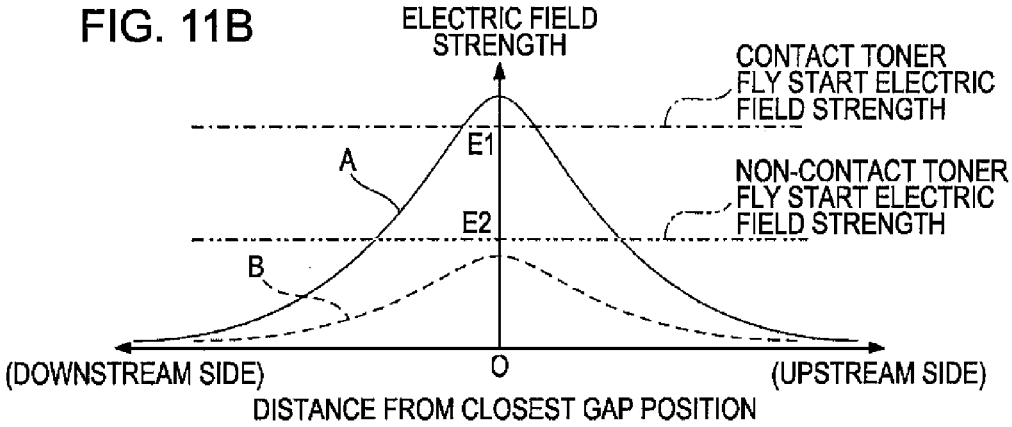
Figure 11C:
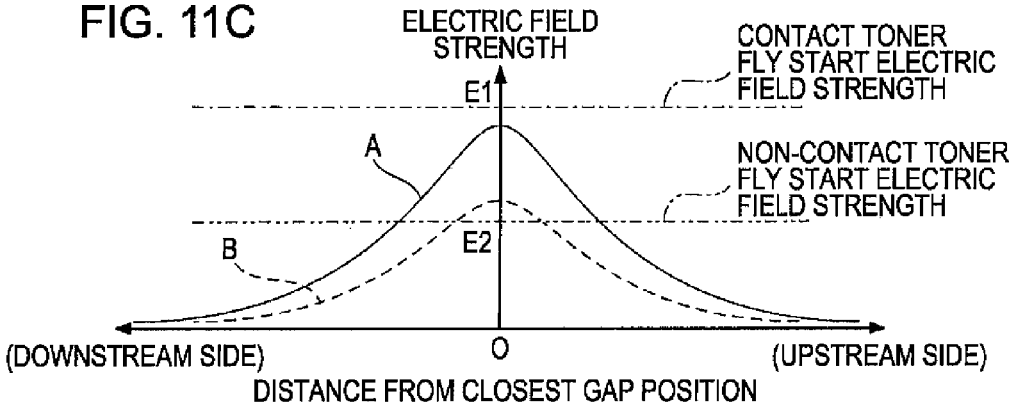

FIG. 10 is a diagram illustrating the electric field strength distribution of the development gap according to this embodiment. FIGS. 11A to 11C are diagrams illustrating the electric field strength distributions of Comparative Examples in the case where the toner layer is more than one layer. In this embodiment, a potential of each unit is set so that the electric field strength at the closest gap position in the exposed portion electric field shown as a curve A of FIG. 10 is allowed to be higher than the contact toner fly start electric field strength E1. In addition, the electric field strength at the closest gap position in the unexposed portion electric field shown as a curve B is allowed to be lower than the contact toner fly start electric field strength E1 and higher than the non-contact toner fly start electric field strength E2. This is for the following reasons.

How to set the exposed portion electric field and the unexposed portion electric field can be determined in various combinations. First, the case where neither field is higher than the non-contact toner fly start electric field strength E2 does not need to be considered. This is because in this case, toner does not fly in the development gap and the development operation cannot be performed. In the case where both of them are higher than the contact toner fly start electric field strength E1, both the contact toner and the non-contact toner fly from the surface of the developing roller opposed to the exposed portion and the unexposed portion. Therefore, from the point of view of toner behavior, this case is not that different from the case of one toner layer or less as the toner layer shown in FIG. 9. Therefore, although the problems such as a base fog and toner scattering still remain, there is an advantage in that toner flies even in an electric field weaker than the single layer toner fly start electric field strength E0.

Next, as illustrated in FIGS. 11A and 11B, a case where an electric field strength at the closest gap position in the unexposed portion electric field shown as a curve B is lower than the non-contact toner fly start electric field strength E2, but an electric field strength at the closest gap position in the exposed portion electric field shown as a curve A is higher than the non-contact toner fly start electric field strength E2 can be considered. In this case, toner flies from the surface of the developing roller opposed to the exposed portion but does not fly from the surface of the developing roller opposed to the unexposed portion. Here, as illustrated in FIG. 11A, in the case where the electric field strength of the exposed portion electric field (curve A) is not higher than the contact toner fly start electric field strength E1, only the non-contact toner flies. On the other hand, as illustrated in FIG. 11B, in the case where the electric field strength of the exposed portion electric field (curve A) is higher than the contact toner fly start electric field strength E1, both the non-contact toner and the contact toner fly. In either case, the toner does not fly from the surface of the developing roller opposed to the unexposed portion of the photosensitive member. Therefore, the amount of toner flying is small, and a sufficient developing density cannot be obtained.

In addition, as illustrated in FIG. 11C, in the case where both the exposed portion electric field (curve A) and the unexposed portion electric field (curve B) are between the contact toner fly start electric field strength E1 and the non-contact toner fly start electric field strength E2, only the non-contact toner flies from the surface of the developing roller opposed to one of the exposed portion and the unexposed portion. Accordingly, the amount of toner flying in the developing gap is small. In addition, since much of the non-contact toner has a small charge as described above, the reproducibility of a potential profile of the surface of the photosensitive member is low. That is, a change in the surface potential of the photosensitive member is not shown precisely as a change in toner density. As a result, in many cases, the density of the obtained image is low, and sufficient image contrast cannot be obtained.

In Comparative Examples, in the electric field distribution in this embodiment illustrated in FIG. 10, only the non-contact toner flies from the surface of the developing roller opposed to the unexposed portion, but both the non-contact toner and the contact toner fly from the surface of the developing roller opposed to the exposed portion. This has the following advantages.

First, since the contact toner is not caused to fly to the unexposed portion, base fog on the unexposed portion can be reduced. As described above, much of the contact toner has a high charge. When the toner is adhered to the unexposed portion of the photosensitive member, a strong electric field is needed to allow the toner to re-fly back to the developing roller. However, since the unexposed portion electric field is weaker than the exposed portion electric field, this effect cannot be expected. Therefore, causing the contact toner not to fly is most effective for preventing the base fog.

In addition, it is thought that the non-contact toner that starts flying at a position where the strongest electric field is exerted in the vicinity of the closest gap position has a relatively high charge. When this toner passes the closest gap position to be adhered to the photosensitive member 22 in a region where the electric field is weak, the toner does not reciprocate any more. In this embodiment, the width of the region where the toner flies at the position opposed to the unexposed portion of the photosensitive member 22, that is, an effective development gap width, is a width L11 of a region where the strength of the unexposed portion electric field is higher than the non-contact toner fly start electric field strength E2 and can be broadened to be larger than that of the case of one toner layer or less as the toner layer illustrated in FIG. 9. Accordingly, sufficient toner reciprocating frequency can be guaranteed for the unexposed portion. Therefore, the possibility that the non-contact toner that flies will adhere to and remain on the photosensitive member is decreased. This also exhibits an effect of suppressing the base fog of the unexposed portion. Particularly, in this embodiment, as illustrated in FIG. 6, a waveform duty cycle of the developing bias Vb is controlled such that the period for which an electric field having a possibility of causing the toner to be returned to the developing roller 44 is generated is longer than the period for which an electric field having the reverse polarity is generated. Therefore, the toner moved to the unexposed portion of the photosensitive member 22 can be more effectively returned to the developing roller 44.

In regard to the exposed portion, a region where the exposed portion electric field is higher than the non-contact toner fly start electric field strength E2 is an effective development gap, and the width L12 can be broadened to be larger than that in the case of one toner layer or less as the toner layer illustrated in FIG. 9. Accordingly, sufficient toner can be caused to fly in the development gap, and the reciprocating frequency of the toner is increased. Therefore, image density and image contrast can be improved.

Moreover, when the exposed portion electric field is higher than the contact toner fly start electric field strength E1, both the non-contact toner and the contact toner fly to the exposed portion. Therefore, sufficient developing density can be obtained. In addition, as described above, reproducibility of the non-contact toner for the potential profile on the photosensitive member is low, and on the other hand, reproducibility of the contact toner having a high charge for the potential profile is high. Therefore, both of the toners are developed while being mixed with each other although a small change in potential acts as a change in density. As a result, disadvantages are compensated, and excellent image quality can be obtained. Specifically, a high image contrast can be obtained for an image of thin lines, and an image having a small density stain can be obtained for an image having a large area.

In this case, the electric field strength E1 needed to cause the contact toner to fly is lower than the single layer toner fly start electric field strength E0, so that the strength of the electric field generated in the development gap can be suppressed to be low. Accordingly, it is possible to suppress toner scattering to the inside and outside of the apparatus, and it is possible to prevent a generation of a discharge in the development gap.

Figure 12:
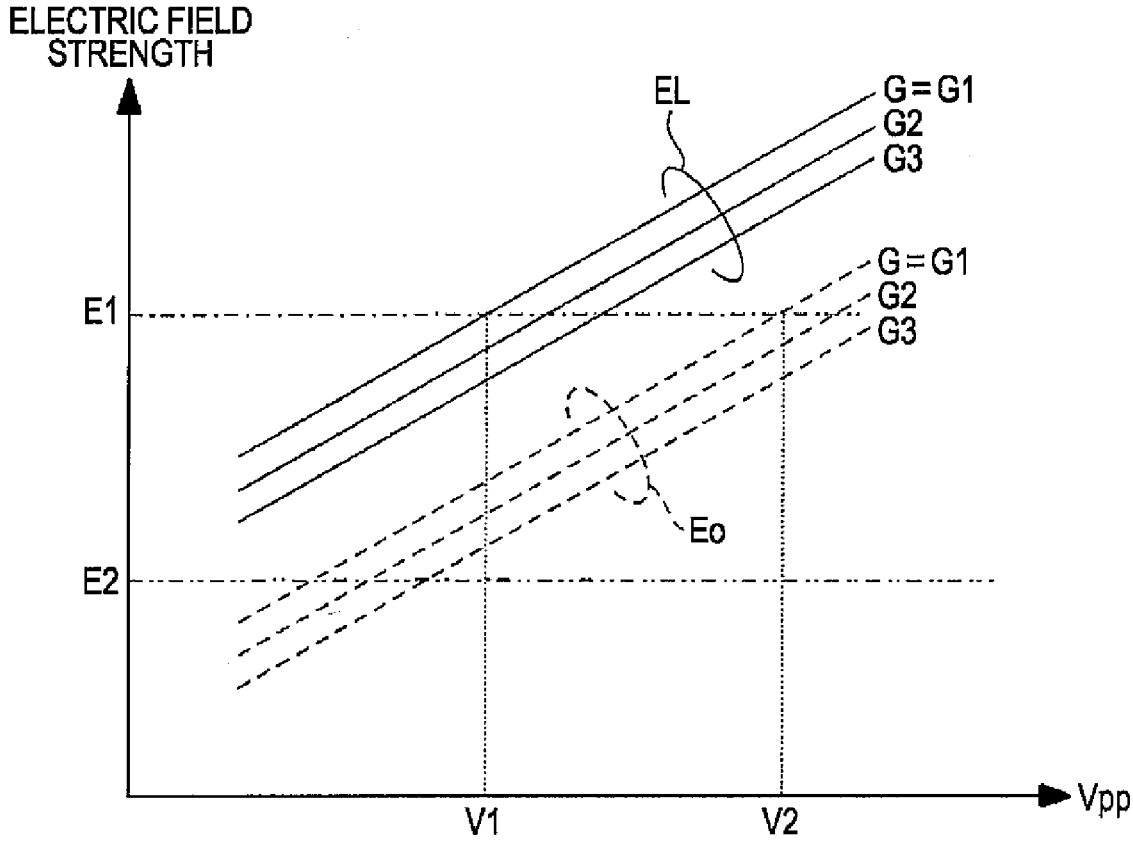
FIG. 12 is a diagram illustrating an example of a method of setting each parameter according to the embodiment.

FIG. 12 is a diagram illustrating an example of a method of setting each parameter according to this embodiment. The parameters for realizing the above-mentioned relationship may include the contact toner fly start electric field strength E1, the non-contact toner fly start electric field strength E2, the exposed portion electric field, and the unexposed portion electric field. Here, among them, the contact toner fly start electric field strength E1, and the non-contact toner fly start electric field strength E2 are inherent properties of the toner, and they are automatically determined when the toner used is determined. The values thereof can be experimentally obtained by performing measurements as follows on the toner used.

Figure 13A:
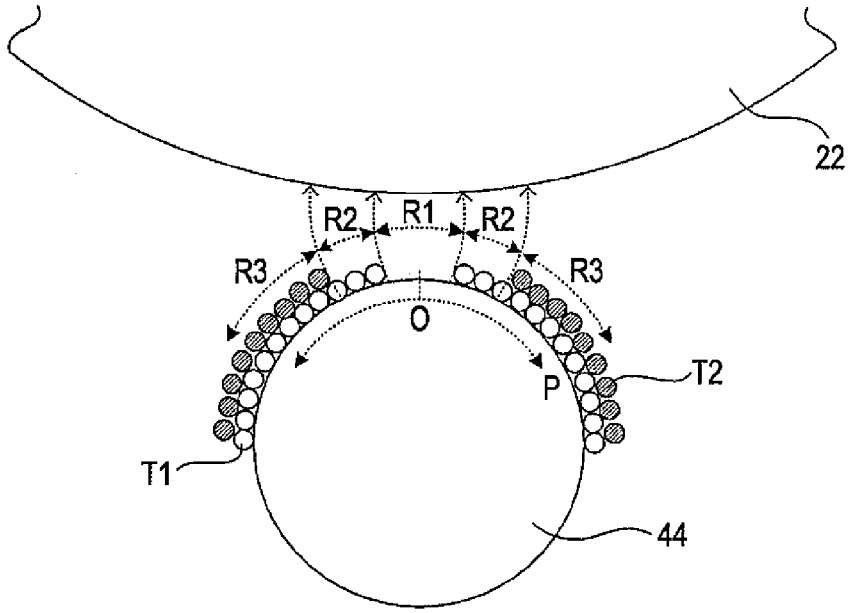
FIGS. 13A and 13B are diagrams illustrating a first example of a method of measuring a fly start electric field strength.
Figure 13B:
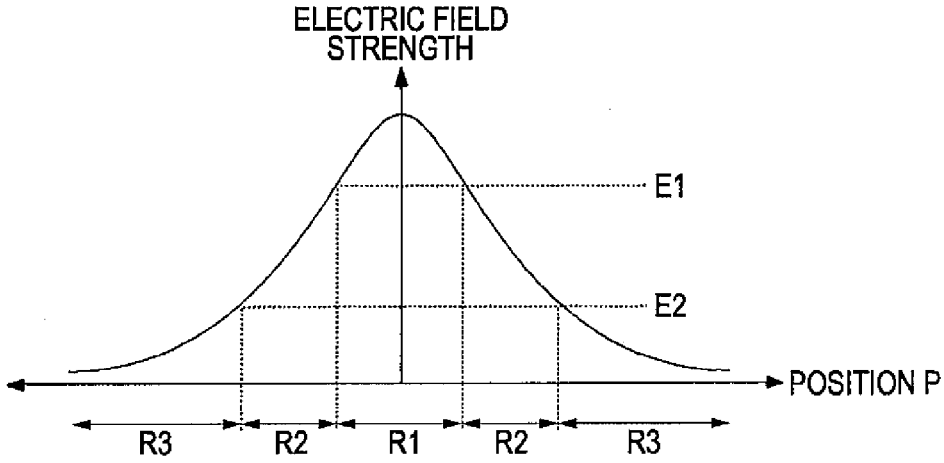

FIGS. 13A and 13B are diagrams illustrating a first example of a method of measuring a fly start electric field strength. In this measurement, as illustrated in FIG. 13A, the photosensitive member 22 and the developing roller 44 are opposed to each other with a gap therebetween at a standstill. The surface of the photosensitive member 22 is uniformly charged at a predetermined surface potential. On the other hand, two toner layers or more are carried on the developing roller 44, and a rectangular-wave alternating-current voltage having an amplitude that does not allow a discharge in the gap is applied thereto. In this measurement, it is preferable that the toner that flies from the developing roller 44 be moved toward the photosensitive member 22. From this point of view, it is preferable that the surface potential applied to the photosensitive member 22 is not a highly negative potential.

The electric field strength in the gap is highest at the position where the photosensitive member 22 and the developing roller 44 are closest to each other, and decreases with distance from the position. From the surface potential of the photosensitive member 22, the alternating-current voltage applied to the developing roller 44, and the size of the gap, an electric field strength distribution for a position P on the peripheral surface of the developing roller 44 can be obtained as illustrated in FIG. 13B.

After the alternating-current voltage is applied to the developing roller 44 for a predetermined time, on the surface of the developing roller 44, as illustrated in FIG. 13A, a region R1 where most of the toner flies and does not exist on the surface, a region R2 where only one layer portion of the toner is left, and a region R3 where most of the toner does not fly appear. This can be observed with the naked eye or using a microscope. In addition, when this experiment is performed in the state where after one layer portion of the color toner on the developing roller is carried, another color toner is carried, although the operation becomes complex, the regions can be identified more easily.

The region R1 is a region where the contact toner also flies, but the region R2 is a region where the non-contact toner flies but the contact toner does not fly. Therefore, as illustrated in FIG. 13B, the electric field strength at a position corresponding to a boundary between the regions R1 and R2 is the contact toner fly start electric field strength E1. Similarly, since the region R3 is a region where the non-contact toner does not fly, the electric field strength at a position corresponding to the boundary between the region R2 and the region R3 is the non-contact toner fly start electric field strength E2.

In this manner, the contact toner and the non-contact toner fly start electric field strengths E1 and E2 can be obtained. In addition, in this experiment, the accuracy of the values can be improved by performing the experiment several times under the same conditions or by performing a statistic process such as changing the conditions including the size of the gap, the amplitude of the alternating-current voltage to measure the values and obtaining an average of the measurement results. In addition, in the case of obtaining the single layer toner fly start electric field strength E0, the same experiment is performed in the state where only one toner layer is carried on the developing roller 44, the electric field strength at a boundary between the region where the toner becomes exhausted on the surface of the developing roller 44 and a region where the toner layer does not exist is obtained, and the obtained value is used as the single layer toner fly start electric field strength E0.

Figure 14A:
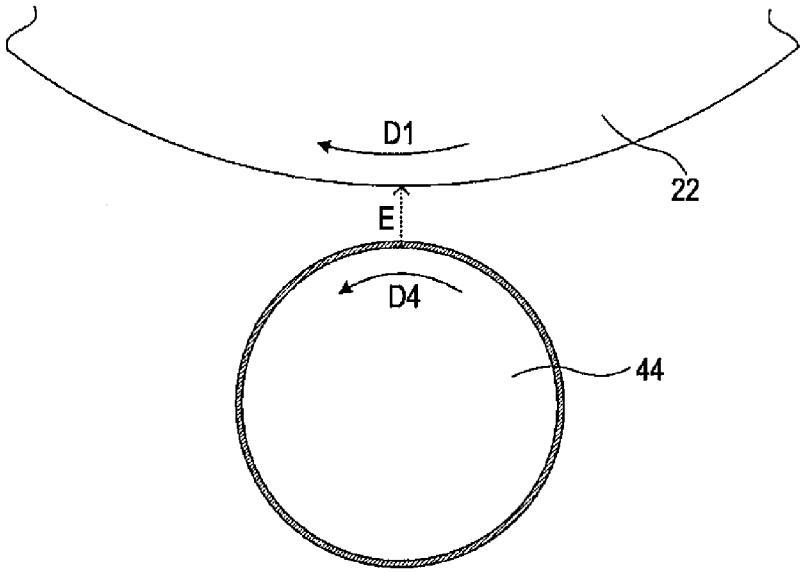
FIGS. 14A and 14B are diagrams illustrating a second example of a method of measuring a fly start electric field strength.
Figure 14B:
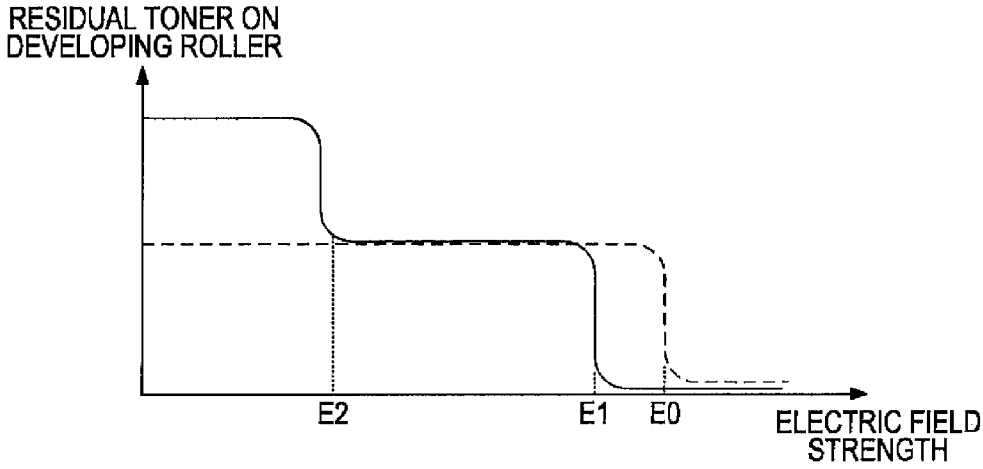

FIGS. 14A and 14B are diagrams illustrating a second example of the method of measuring a fly start electric field strength. In this measurement, as illustrated in FIG. 14A, similarly to the above-mentioned method, a rectangular-wave alternating-current voltage is applied while rotating the developing roller 44 in the state which the photosensitive member 22 is charged and toner is carried-on the developing roller 44. The electric field E in the gap is changed to various values to perform the experiment, and the relationship between the electric field strength and the residual toner on the developing roller 44 is measured.

In order to change the electric field strength, the combination of the surface potential of the photosensitive member 22, the size of the gap, and the amplitude of the alternating-current voltage applied to the developing roller 44 is changed. However, changing either the surface potential of the photosensitive member 22 or the amplitude of the alternating-current voltage is the simplest way. In addition, instead of measuring the residual toner on the developing roller 44, the amount of the toner adhered to the photosensitive member 22 or the density of a toner image generated by the toner adhered to the photosensitive member 22 may be detected.

In this method, as shown as a solid line in FIG. 14B, the toner hardly reduces when the electric field strength is low, but the toner sharply reduces when the electric field strength reaches to a certain value. It is thought that this is because the no-contact toner starts flying, and the electric field strength at this time is the non-contact toner fly start electric field strength E2. As the electric field strength is increased, change in the residual toner is decreased. It is thought that the electric field strength does not reach a level that causes the contact toner to fly although most of the non-contact toner flies. When the electric field strength is further increased, the residual toner sharply decreases at a certain level of the electric field strength. It is thought that the contact toner starts flying, and the electric field strength at this time is the contact toner fly start electric field strength E1.

In the case where the toner layer on the developing roller 44 is a single layer, as shown as a dashed line in FIG. 14B, a significant change in the residual toner occurs only one time, and the electric field strength corresponding to this change is the electric field strength to cause the single layer toner to start flying E0.

Returning to FIG. 12, the method of setting each parameter according to this embodiment will be continued. As illustrated in FIG. 12, the amplitude Vpp of the developing bias is represented by the horizontal axis, and the electric field strength is represented by the vertical axis, to plot the electric field strengths of the exposed portion and the unexposed portion. Here, the size of the gap at the closest position in the development gap DG is denoted by G, the electric field strength EL of the exposed portion electric field at the corresponding position will be represented using FIG. 6 by the following expression:

$$EL=(VL-V\mathrm{min})/G=\{VL-(\mathrm{Vdc}-\mathrm{Vpp}/2)\}/G=\{\mathrm{Vpp}+2(VL-\mathrm{Vdc})\}/2G.$$

Similarly, the electric field strength Eo of the unexposed portion at the closest position in the development gap DG can be represented by the following expression:

$$Eo=(Vo-V\mathrm{min})/G=\{\mathrm{Vpp}+2(Vo-\mathrm{Vdc})\}/2G.$$

As described above, the electric field strengths of the exposed portion and the unexposed portion are proportional to the amplitude Vpp of the developing bias and are inversely proportional to the size G of the gap. The electric field strengths of the exposed portion and the unexposed portion for the sizes G1, G2, and G3 (here, G1<G2<G3) of the three types of gap are plotted as the graph of FIG. 12.

In this graph, two conditions are given:

(1) the electric field strength EL of the exposed portion electric field is greater than the contact toner fly start electric field strength E1, and (2) the electric field strength Eo of the unexposed portion is greater than the non-contact toner fly start electric field strength E2 but smaller than the contact toner fly start electric field strength E1.

A combination of the amplitude Vpp of the developing bias and the size G of the gap, which satisfies the given two conditions, is the desirable combination. For example, when the size G of the gap is regarded as G1, the amplitude Vpp of the developing bias has a value between V1 to V2 of FIG. 12.

When such a combination is not found, the surface potential Vo of the photosensitive member may be adjusted. The exposed portion potential VL of the photosensitive member 22 is a value dependent on the property of the material of the photosensitive member and cannot be set freely. In addition, it has an effect on the image density. In addition, the direct current component Vdc of developing bias is a parameter which has a significant affect on the image density. On the contrary, the unexposed portion potential Vo of the photosensitive member 22 can be controlled by the magnitude of the charging bias applied to the charging unit 23, and has a small effect on the image density. By adjusting the parameters, as can be seen from the above expression, it is possible to change only the electric field strength Eo of the unexposed portion.

Next, the surface structure of the developing roller suitable for realizing the developing operation described above will be described. As described above, objects of this embodiment are to carry more than one toner layer, specifically, both the contact toner and the non-contact toner, on the surface of the developing roller, and reconcile the improvement in the developing density and the suppression of the base fog and the toner scattering by suitably controlling the electric field generated in the development gap. However, if the binding force exerted on the non-contact toner from the developing roller is small, there is a concern that the non-contact toner will detach from the surface of the developing roller due to the rotation of the developing roller and scatter to the inside and outside of the apparatus.

This problem is particularly significant in structures in which toner is carried on the entire surface of the developing roller, like a roller (blast roller) of a type in which the surface is subjected to blast processing to increase the surface area, which are widely used. In addition, in this kind of structure, a large amount of toner scatters even when more than one toner layer is carried on the developing roller. Therefore, the structure cannot be practically used. In addition, even in the case of increasing the rotation frequency of the developing roller in response to the request for an increase in process speed, toner detached from the surface of the developing roller scatters increasingly.

It has been thought that the detachment of the toner from the surface of the developing roller is mainly caused by the centrifugal force exerted on the toner due to rotation. However, according to the research of the inventors, it has been discovered that this phenomenon is affected by an air current near the surface of the developing roller, which occurs due to the rotation of the developing roller. In particular, the fact that the detachment of the toner having a small particle size from the surface of the developing roller is heavier than that of the toner having a large particle size even though toner having a small particle size has a small mass and has less centrifugal force exerted on it has been discovered. It is thought that this phenomenon occurs because wind pressure is exerted on the toner due to the rotation of the surface of the developing roller. Therefore, in this embodiment, in order to solve this problem, the surface structure of the developing roller is made as follows.

Figure 15:
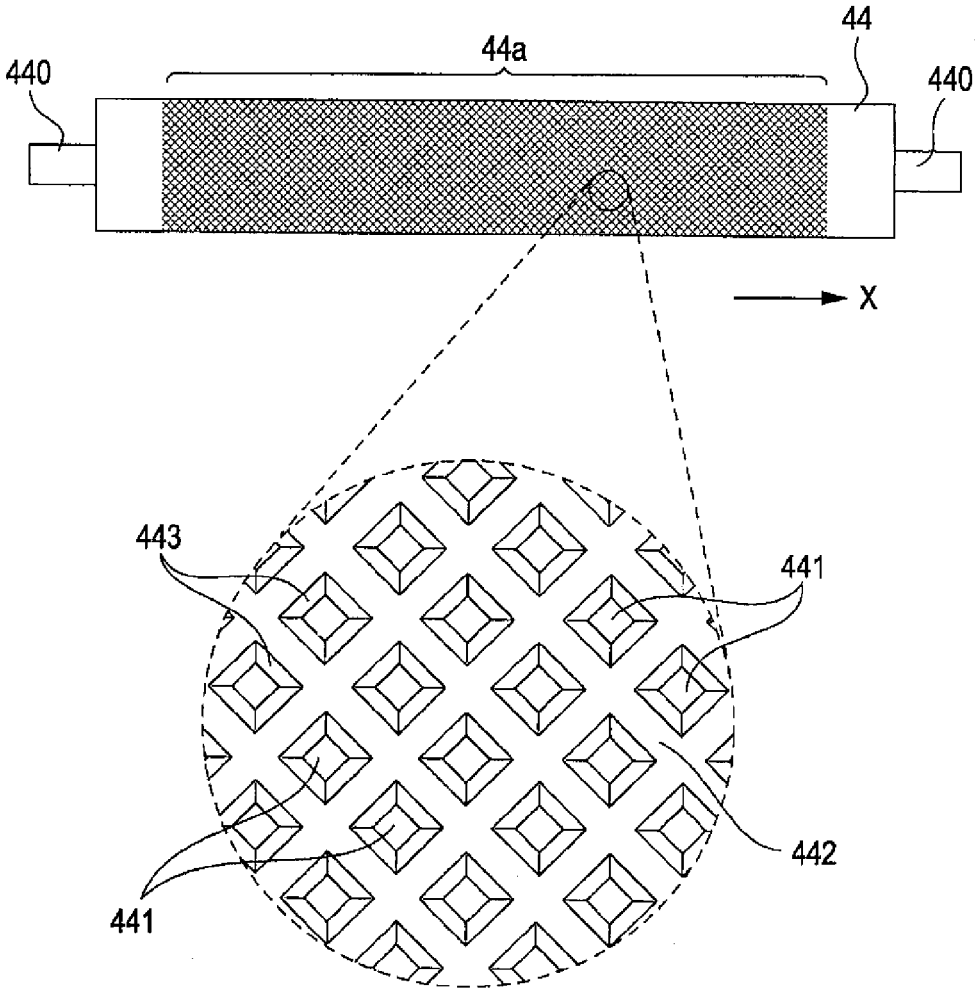
FIG. 15 is a partially enlarged view illustrating a developing roller and the surface thereof.

FIG. 15 is a partially enlarged view illustrating the developing roller and the surface thereof. The developing roller 44 has a shape of a substantially cylindrical roller formed as a metal tube in which its surface is made of a conductive material. A shaft 440 is provided at both ends thereof in a longitudinal direction to be coaxial with the roller, and the shaft 440 is attached to the main body of the developer container with an axle to allow the developing roller 44 to rotate. In a central region 44*a* of the surface of the developing roller 44, as illustrated by the partially enlarged view (in the dotted circle) of FIG. 5, plural convex portions 441 arranged regularly and uniformly and plural concave portions 442 surrounding the convex portions 441 are provided.

Each of the convex portions 441 protrudes forward from the base of FIG. 15, and the top surface of each concave portion 441 defines a portion of a single cylindrical surface (enveloping cylindrical surface) that is coaxial with the axis of rotation of the developing roller 44. The concave portion 442 is formed as a continuous groove surrounding the convex portions 441 in a net shape, and the entire concave portion 442 defines another cylindrical surface which is coaxial with the axis of rotation of the developing roller 44 and different from the cylindrical surface defined by the convex portions. The convex portion 441 and the concave portion 442 surrounding it are connected with a gradually inclined surface 443. Specifically, the inclined surface 443 has a component in the outward radial direction of the developing roller 44 (upward direction in FIG. 16), that is, in a direction further away from the axis of rotation of the developing roller 44. The developing roller 44 having the above-mentioned structure can be manufactured by a manufacturing method using a so-called rolling process disclosed in JP-A-2007-140080. Accordingly, the regular and uniform uneven portions can be formed on the cylindrical surface of the developing-roller 44. The obtained developing roller 44 can carry a uniform and optimal amount of toner on its cylindrical surface, and a uniform rolling motion characteristic (easily rolling) of the toner on the cylindrical surface of the developing roller 44 can be obtained. As a result, it is possible to prevent local charge failure and transportation failure of the toner, and good developing characteristics can be exhibited. In addition, since the uneven portion is formed by using a mold, unlike a general developing roller manufactured by blast processing, the apex of the convex portion of the obtained uneven portion can be given a relatively larger width. The uneven portion has an excellent mechanical strength. Particularly, a portion pressed by a mold can be given an improved mechanical strength. Therefore, the obtained uneven portion has an excellent mechanical strength as compared with that obtained by performing a cutting process or the like. The developing roller 44 having the uneven portion can exhibit excellent durability. In addition, since the width of the apex of the convex portion of the uneven portion is relatively large, changes in the shape due to abrasion rarely occur. Therefore, it is possible to prevent a significant degradation in developing characteristics, and excellent developing characteristics can be exhibited for a long time.

Figure 16A:
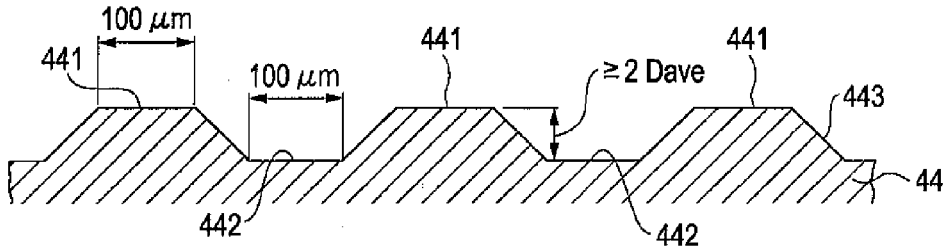
FIGS. 16A to 16D are cross-sectional views illustrating the structure of the surface of the developing roller in detail.

FIGS. 16A to 16D are cross-sectional views illustrating the structure of the surface of the developing roller in detail. As illustrated in FIG. 16A, in a cross-sectional view of the surface of developing roller 44, the convex portion 441 protruding outward with respect to the circumferential direction and the concave portion 442 receded therefrom are arranged alternatively. In addition, the convex portion 441 and the concave portion 442 are connected with the inclined surface 443. The dimension of the top surface of the convex portion 441 and the width of the concave portion 442 may be set to, for example, 100 μm but not limited thereto. A height difference between the convex portion 441 and the concave portion 442, in other words, the depth of the concave portion 442 having a shape of a groove surrounding the convex portion 441 is twice the volume average particle size Dave of the toner used or greater.

Figure 16B:
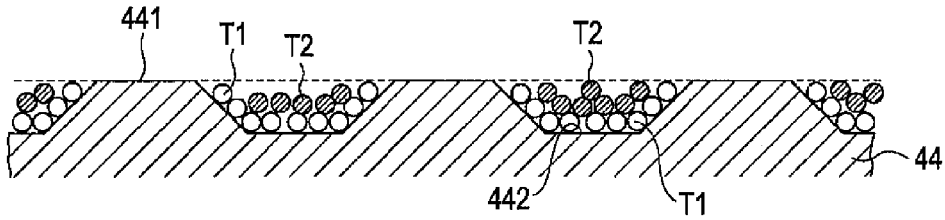

Accordingly, as illustrated in FIG. 16B, two toner layers or more can be carried on the concave portion 442 so as not to spread over a line (shown as a dashed line) connecting the top surfaces of the convex portion 442. In FIG. 16B, a white circle represents the contact toner T1 which directly contacts the surface of the developing roller 44. In addition, a hatched circle represents the non-contact toner T2 which does not directly contact the surface of the developing roller 44 but is carried on the concave portion 442.

The line connecting the top surfaces of the convex portion 442, which is shown as the dashed line in FIG. 16B, is a curve on the enveloping cylindrical surface when the top surface of each convex portion 441 is thought of as a portion of the cylindrical surface. The toner carried on the concave portion 442 does not cross over the line, and this means that the toner is not exposed to be on the outer side of the enveloping cylindrical surface on the surface of the developing roller 44. Therefore, even though a strong air current occurs on the surface of the developing roller 44 due to the rotation of the developing roller 44, the toner carried at the position receded from the surface of the developing roller 44 is not affected, and the non-contact toner to which a small binding force is exerted from the developing roller is prevented from deviating and flying.

Figure 16C:
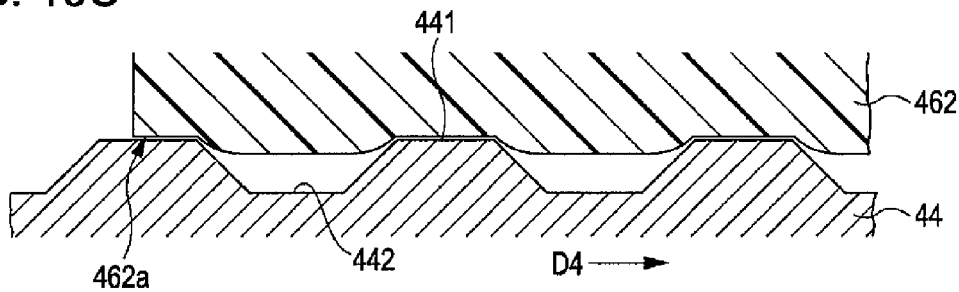

In order to carry the toner on the surface of the developing roller 44 as illustrated in FIG. 16B, as illustrated in FIG. 16C, an upstream edge 462*a* of the elastic member 462 of the restriction blade 46 is allowed to come in contact with the convex portion 441 of the developing roller 44 in the rotation direction D4 of the developing roller, that is, toner adhesion to the convex portion 441 is restricted by edge control. In addition, a material having a suitable elasticity is selected for the elastic member 462 to allow the elastic member 462 to protrude slightly toward the concave portion 442 at a position opposed to the concave portion 442. Accordingly, the toner adhesion to the convex portion 441 is restricted, and it is possible to prevent the toner from spreading over the enveloping cylindrical surface and being carried on the concave portion 442.

Figure 16D:
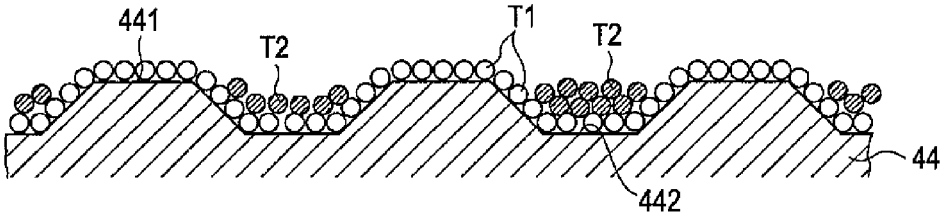

In addition, as described above, a strong binding force toward the developing roller 44 is exerted on the contact toner. Therefore, it is thought that resistance of the contact toner against the air current is relatively high, detachment of the toner rarely occurs even when the toner is exposed to spread over the enveloping cylindrical surface. From this point of view, as illustrated in FIG. 16D, a contact angle or a contact pressure of the restriction plate 46 may be controlled to allow the adhesion of the one toner layer or less to the convex portion 441.

Here, carrying the toner only on the concave portion 442 makes it possible to obtain the following advantages. First, in order to form the uniform toner layer on the convex portion 441, it is necessary to precisely control the gap between the restriction blade 46 and the convex portion 441. However, in order to carry the toner only on the concave portion 442, the restriction blade 46 and the convex portion 441 are allowed to come in contact with each other in order to remove the toner on the convex portion 441. It is relatively easy to realize this. In addition, since the amount of the toner transported is determined by the volume of space generated in the gap between the restriction blade 46 and the concave portion 442, it is possible to stabilize the amount of the toner transported.

In addition, there is an advantage in terms of the good quality of the transported toner layer. That is, when the toner is carried on the convex portion 441, degradation of the toner caused by contact and friction with the restriction blade 46 occurs easily. Specifically, there are problems in that the flow properties and charging properties of the toner are degraded, the toner is compacted into powder and agglutinated, and the toner is fixed to the developing roller 44 to cause a filming phenomenon. For this reason, a problem rarely occurs when the toner is carried on the convex portion 442 that is not strongly pressed by the restriction blade 46. In addition, since the toner carried on the convex portion 441 and the toner carried on the concave portion 442 employ very different contact methods from each other to contact the restriction blade 46, a variation in charges of the toner is expected. However, since the toner is carried on only the concave portion 442, it is possible to suppress such a variation.

In particular, recently, in order to achieve high-resolution of images and reductions in the amount of the toner consumed and power consumption, reductions in toner particle size and in fixing temperature are required. The configuration of this embodiment makes it possible to satisfy the requirements. Even though to start charging of toner with a small particle size is slow, the saturated charge thereof is high. Accordingly, there is a tendency for the toner carried on the convex portion 441 to have a significantly higher charge (to be overcharged) than that of the toner carried on the concave portion 442. The difference of the charge quantities is shown on an image as a development history. In addition, in regard to toner having a low melting point, the adhesion of the toners to each other or the adhesion of the toner to the developing roller 44 or the like occurs easily due to contact and friction therebetween. However, this problem rarely occurs in the configuration of this embodiment in which the toner is carried only on the concave portion 442.

In addition, according to this embodiment, the particle size of the toner used is not particularly limited. However, in the case where toner having a volume average particle size Dave of 5 μm or less is used, a significant effect can be exhibited. First, since the particle size of the toner is small, van der Waals force is strongly exerted thereto, and the toner having a small particle size is difficult to fly from the developing roller 44. In addition, due to the image force strongly exerted on the developing roller 44 made of the conductive material, the toner is difficult to fly from the developing roller 44. Consequently, the developing method of this embodiment in which more than one toner layer is carried on the developing roller 44 and both the contact toner and the non-contact toner are allowed to fly to contribute to the developing operation, has exhibited excellent effects.

In addition, with respect to about 5 μm as a reference, the toner having a volume average particle size of equal to or less than the reference further shows properties as powder, and its behavior becomes different from the toner having a larger volume average particle size. For example, since the toner having a small particle size has a small mass, the toner floats in the air for a long time once the toner flies, and the toner may spread throughout the apparatus and leak from the apparatus. Since the apparatus of this embodiment effectively suppresses the toner scattering, this problem does not occur even in the case of using the toner having a small particle size.

In Example, an example set values of the parameters in the case of using toner having a volume average particle size of 4.5 μm for the image forming apparatus of this embodiment are shown as follows:

the size G of the development gap=100 μm, the amplitude Vpp of the developing bias=1200 V (duty cycle WD=60%), the weighted average voltage Vave of the developing bias=−200 V, the unexposed portion potential (photosensitive member charge potential) Vo=−450V, and the exposed portion potential VL=−150V.

In this condition, the electric field strength Eo of the unexposed portion=$4.7\times10^6$ V/m, and the electric field strength EL of the exposed portion=$7.7\times10^6$ V/m.

For the actual measurement values ($7.1\times10^6$ V/m and $3.9\times10^6$ V/m, respectively) of the contact toner and the non-contact toner fly start electric field strengths E1 and E2 illustrated in FIG. 7B, the conditions (1) and (2) described above are satisfied.

As described above, in this embodiment, more than one toner layer, more strictly, toner layers including both the contact toner which directly contacts the surface of the developing roller and the non-contact toner which does not directly contact the surface of the developing roller are carried on the surface of the developing roller 44. As a result, a sufficient amount of the toner can be transported in the development gap DG, so that it is possible to obtain a high image density.

In addition, both the contact toner and the non-contact toner are carried on the developing roller. Therefore, it can be expected that the contact toner can be calculated by the non-contact toner which starts flying at a lower electric field strength. Accordingly, the electric field strength of the electric field generated in the development gap DG does not need to be high. This prevents the toner flying in the development gap DG from scattering out of the gap, and suppresses the generation of a discharge in the gap.

In addition, in consideration that the fly start electric field strengths of the contact toner and the non-contact toner are different from each other, the electric field strength of the toner fly electric field on the surface of the developing roller opposed to the unexposed portion of the photosensitive member is set to be higher than the non-contact toner fly start electric field strength E2 and lower than the contact toner fly start electric field strength E1, thereby causing only the non-contact toner to fly from the surface of the developing roller opposed to the unexposed portion and suppressing the contact toner from flying. Accordingly, it is possible to guarantee a large width for the development gap while suppressing unnecessary toner adhesion to the unexposed portion, thereby suppressing a generation of a base fog.

In addition, since the electric field strength of the toner fly electric field on the surface of the developing roller opposed to the exposed portion of the photosensitive member is set to be higher than the contact toner fly start electric field strength E1, both the contact toner and the non-contact toner are allowed to fly to contribute to the developing operation, so that it is possible to obtain a high developing density. In addition, since the development is performed by using both the contact toner and the non-contact toner, and any image such as an image of thin lines or an image having a large area can obtain good image quality.

In addition, the surface of the developing roller is provided with the structure including the uniform uneven portions, a height difference between the convex portion and the concave portion is set to be twice the volume average particle size of the toner or greater to allow the toner to be carried only on the concave portion. Therefore, it is possible to carry the two or more toner layers on the developing roller 44 properly. In addition, since the developing roller 44 is rotated while the toner is accommodated into the concave portion, it is possible to prevent the toner from being detached from the surface of the developing roller due to the rotation.

As described above, in this embodiment, the photosensitive member 22 and developing roller 44 function as the "latent image holder" and the "toner carrying roller" of the invention, respectively. In addition, the exposed portion of the surface of the photosensitive member 22 corresponds to the "image portion", and the unexposed portion corresponds to the "non-image portion" of the invention. In addition, in this embodiment, the bias power 140 and the restriction blade 46 function as the "electric field forming unit" and the "restriction member" of the invention, respectively.

In addition, the invention is not limited to the above-mentioned embodiment, and modifications thereof can be made without departing from the spirit and scope of the invention. For example, the numerical values used to describe the embodiment are only examples, and the invention is not limited thereto.

In addition, the embodiment applies the image forming apparatus of the type in which toner is adhered to potions from which charges are removed by exposure, that is, the so-called negative latent image type. The exposed region (exposed portion) on the photosensitive member 22 corresponds to the "image portion" of the invention to which toner is to be adhered, and the unexposed region (unexposed portion) corresponds to the "non-image portion" of the invention. However, the invention may also apply an image forming apparatus of a type in which toner is adhered to a region where charges are generated by exposure, that is, a so-called positive latent image type. In this case, an exposed region on the photosensitive member corresponds to the "image portion", and an unexposed portion corresponds to the "non-image portion". In addition, in this embodiment the negatively-charged toner is used. However, the invention may also apply the image forming apparatus using a positively-charged toner.

In addition, the surface structure of the developing roller 44 in this embodiment is formed by uniformly arranging the convex portions 441 of which the top surface is substantially trapezoidal and the concave portion 442 provided to surround the convex portions 441. However, the shape of the convex portion or the surface structure of the developing roller is not limited thereto. For example, a structure in which a number of dimples are provided on a substantially flat enveloping cylindrical surface, or a structure having spiral grooves can be used. Even in this case, a depth of the dimple or the groove is set to be twice of the volume average particle size of the toner or greater, so that it is possible to transport two or more toner layers. In addition, from the point that flow of the toner on the surface of the developing roller is allowed to prevent the fixing of the toner to the concave portion, it is preferable that the concave portion for carrying the toner is continuous.

In addition, the image forming apparatus of this embodiment is a color image forming apparatus equipped with the developer container 4K in the rotary developing unit 4 and also functions as an apparatus for mixing the toner in the developer container by rotating the developer container 4K or the like. However, the application of the invention is not limited thereto. For example, a monochrome image forming apparatus for forming a monochrome image having only a single developer container, and a so-called tandem-type image forming apparatus having plural developer containers provided around an intermediate transfer member can also be properly applied to the invention.

The entire disclosure of Japanese Patent Application No. 2008-232895, filed Sep. 11, 2008 is expressly incorporated by reference herein.

What is claimed is:

1. An image forming apparatus comprising:

a latent image holder that holds on its surface an electrostatic latent image in which an image portion to which toner is to be adhered and a non-image portion to which toner is not to be adhered have different potentials;

a toner carrying roller that has a roller shape to be opposed to the latent image holder with a predetermined gap therebetween, and carries a toner layer including both a contact toner which directly contacts a surface of the roller and a non-contact toner which contacts the contact toner but does not contact the surface of the roller; and an electric field forming unit that forms, when an electric field strength needed for a surface of the toner carrying roller to cause the non-contact toner to fly from the surface of the toner carrying roller is defined as a non-contact toner fly start electric field strength, and an electric field strength needed for the surface of the toner carrying roller to cause the contact toner to fly from the surface of the toner carrying roller is defined as a contact toner fly start electric field strength, an alternating electric field to cause the electric field strength exerted between the non-image portion on the surface of the latent image holder and the surface of the toner carrying roller to be lower than the contact toner fly start electric field strength and higher than the non-contact toner fly start electric field strength, between the latent image holder and the toner carrying roller, as a toner fly electric field.

2. The image forming apparatus according to claim 1, wherein the electric field forming unit forms the toner fly electric field so as to cause the electric field strength exerted between the image portion on the surface of the latent image holder and the surface of the toner carrying roller to be higher than the contact toner fly start electric field strength.

3. The image forming apparatus according to claim 1, wherein the electric field forming unit forms an electric field to cause a time period for which an electric field having a polarity that causes the toner to fly in a direction from the latent image holder toward the toner carrying roller is generated to be longer than a time period for which an electric field having the reverse polarity is generated.

4. The image forming apparatus according to claim 1, wherein the toner carrying roller is configured such that its surface for carrying the toner is made of a conductive material.

5. The image forming apparatus according to claim 1, wherein the toner carrying roller is provided with a concave portion formed by performing a rolling process on a surface of a metal tube.

6. The image forming apparatus according to claim 1, wherein the toner carrying roller is provided with a concave portion for accommodating the toner on a cylindrical surface, and the depth of the concave portion is twice the volume average particle size of the toner or larger.

7. The image forming apparatus according to claim 6 further comprising a restriction member that restricts the toner layer formed on the surface of the toner carrying roller other than the concave portion to be one toner layer or less.

8. The image forming apparatus according to claim 6, further comprising a restriction member that restricts the carrying of the toner on the surface of the toner carrying roller other than the concave portion.

9. The image forming apparatus according to claim 1, wherein the volume average particle size of the toner is equal to or less than 5 μm.

10. An image forming apparatus comprising: a latent image holder that holds an electrostatic latent image in which an image portion to which toner is to be adhered and a non-image portion to which toner is not to be adhered have different potentials;

a toner carrying roller that has a roller shape to be opposed to the latent image holder with a predetermined gap therebetween, and carries a toner layer including both a contact toner which directly contacts a surface of the roller and non-contact toner which contacts the contact toner but does not contact the surface of the roller; and an electric field forming unit that forms an alternating electric field to cause the toner on a surface of the toner carrying roller to fly between the latent image holder and the toner carrying roller, as a toner fly electric field, wherein the non-contact toner is caused to fly, but the contact toner is not caused to fly, between the non-image portion on the surface of the latent image holder and the surface of the toner carrying roller, at a position where the latent image holder and the toner carrying roller are opposed to each other.

11. The image forming apparatus according to claim 10, wherein both the contact toner and the non-contact toner are caused to fly between the image portion on the surface of the latent image holder and the surface of the toner carrying roller, at the position where the latent image holder and the toner carrying roller are opposed to each other.

12. An image forming method comprising:

disposing a latent image holder that holds an electrostatic latent image and a toner carrying roller having a roller shape to be opposed to each other with a predetermined gap therebetween;

forming an electrostatic latent image in which an image portion to which toner is to be adhered and a non-image portion to which toner is not to be adhered have different potentials, on a surface of the latent image holder;

forming a toner layer including both contact toner which directly contacts a surface of the roller and non-contact toner which contacts the contact toner but does not contact the surface of the roller on a surface of the toner carrying roller to be transported to a position opposed to the latent image holder;

forming an alternating electric field to cause toner on the surface of the toner carrying roller to fly between the latent image holder and the toner carrying roller, as a toner fly electric field, thereby developing the electrostatic latent image with the toner; and causing the non-contact toner to fly and the contact toner not to fly between the non-image portion on the surface of the latent image holder and the surface of the toner carrying roller, at a position where the latent image holder and the toner carrying roller are opposed to each other.

* * * * *